US007104867B2

(12) United States Patent
Jeong

(10) Patent No.: US 7,104,867 B2
(45) Date of Patent: Sep. 12, 2006

(54) APPARATUS AND METHOD FOR SEQUENTIALLY POLISHING AND LOADING/UNLOADING SEMICONDUCTOR WAFERS

(75) Inventor: In Kwon Jeong, Sunnyvale, CA (US)

(73) Assignee: Oriol Inc., Santa Clara, CA (US)

( * ) Notice: Subject to any disclaimer, the term of this patent is extended or adjusted under 35 U.S.C. 154(b) by 0 days.

(21) Appl. No.: 11/313,996

(22) Filed: Dec. 22, 2005

(65) Prior Publication Data

US 2006/0105680 A1 May 18, 2006

Related U.S. Application Data

(60) Continuation of application No. 11/149,286, filed on Jun. 10, 2005, now Pat. No. 7,004,815, which is a division of application No. 09/839,508, filed on Apr. 20, 2001, now Pat. No. 6,942,545.

(51) Int. Cl.
*B24B 5/00* (2006.01)

(52) U.S. Cl. ..... 451/11; 451/5; 451/8; 451/41; 451/285

(58) Field of Classification Search ..... 451/5, 451/8, 11, 41, 339, 285–290, 256, 259, 247, 451/332, 401
See application file for complete search history.

(56) References Cited

U.S. PATENT DOCUMENTS

| | | | | | |
|---|---|---|---|---|---|
| 2,998,680 | A | * | 9/1961 | Lipkins | 451/288 |
| 3,518,798 | A | * | 7/1970 | Boettcher | 451/288 |
| 3,659,386 | A | * | 5/1972 | Goetz et al. | 451/37 |
| 3,665,648 | A | * | 5/1972 | Yamanaka | 451/292 |
| 3,731,435 | A | * | 5/1973 | Boettcher et al. | 451/288 |
| 3,762,103 | A | * | 10/1973 | Nielsen | 451/260 |
| 3,913,271 | A | | 10/1975 | Boettcher | |
| 4,020,600 | A | * | 5/1977 | Day | 451/398 |
| 4,502,252 | A | * | 3/1985 | Iwabuchi | 451/269 |
| 4,829,716 | A | * | 5/1989 | Ueda et al. | 451/292 |
| 5,205,082 | A | | 4/1993 | Shendon et al. | |
| 5,443,416 | A | * | 8/1995 | Volodarsky et al. | 451/388 |
| 5,498,199 | A | | 3/1996 | Karlsrud et al. | |
| 5,738,574 | A | | 4/1998 | Tolles et al. | |
| 5,924,916 | A | | 7/1999 | Yamashita | |
| 6,136,715 | A | | 10/2000 | Shendon et al. | |
| 6,146,249 | A | | 11/2000 | Hu et al. | |

FOREIGN PATENT DOCUMENTS

| | | |
|---|---|---|
| JP | 2001-18161 | 1/2001 |
| JP | 2001-18169 | 1/2001 |

* cited by examiner

*Primary Examiner*—Lee D. Wilson
*Assistant Examiner*—Anthony Ojini
(74) *Attorney, Agent, or Firm*—McKenna, Long & Aldridge LLP

(57) ABSTRACT

A chemical mechanical polishing (CMP) apparatus and method for polishing semiconductor wafers utilizes multiple wafer carriers that are transferred to different positions about a polishing pad to polish at least one semiconductor wafer while another semiconductor wafer is being loaded onto or unloaded from one of the wafer carriers. The different positions include multiple polishing positions and one or more loading/unloading positions. In some embodiments, the CMP apparatus is configured such that a semiconductor wafer is polished at a loading/unloading position. The CMP apparatus may also be configured to continuously polish one or more semiconductor wafers while the wafer carriers are being transferred to different positions. Thus, the CMP apparatus can continuously process the semiconductor wafers without significant idle periods. Consequently, in these embodiments, the efficiency of the CMP apparatus is significantly increased. Furthermore, the wafer carriers of the CMP apparatus are preferably restricted to a small area to decrease the footprint of the apparatus.

15 Claims, 29 Drawing Sheets

APPARATUS AND METHOD FOR SEQUENTIALLY POLISHING AND LOADING/UNLOADING SEMICONDUCTOR WAFERS

This application is a continuation application of U.S. patent application Ser. No. 11/149,286 filed on Jun. 10, 2005 now U.S. Pat. No. 7,004,815, which is a divisional of U.S. patent application Ser. No. 09/839,508 filed on Apr. 20, 2001 now U.S. Pat. No. 6,942,545, both of which are incorporated by reference, as if fully set forth herein.

FIELD OF THE INVENTION

The invention relates generally to chemical mechanical polishing (CMP) systems, and more particularly to an apparatus and method for chemically and mechanically polishing multiple semiconductor wafers on a single polishing pad.

BACKGROUND OF THE INVENTION

During a fabrication process of a high density multi-layered semiconductor device, one of the most important processing steps is planarizing a layer of a semiconductor wafer by removing uneven topographic features of the wafer. The layer planarization allows patterns that are subsequently formed above that layer to be more uniform. In the case of conductive patterns, the planarization of the underlying layer reduces the probability of electrical shorts between the conductive patterns, which is a growing concern as the density of microelectronic circuitry included in a semiconductor device is progressively increased.

Chemical mechanical polishing (CMP) is a well-accepted technique to planarize a layer of a semiconductor wafer during the fabrication process by chemically and mechanically removing uneven topographic features of the wafer. A conventional CMP technique involves polishing the surface of a wafer with a rotating polishing pad using a slurry of colloidal particles in an aqueous solution. The slurry promotes planarization of the wafer surface by producing a chemical reaction with the wafer surface and by providing abrasives to "grind" the wafer surface with the polishing pad.

A common conventional CMP system utilizes a single polishing pad to polish one semiconductor wafer at a time. However, CMP systems have been developed that can simultaneously polish multiple semiconductor wafers on one or more polishing pads to increase throughput. U.S. Pat. No. 5,498,199 to Karlsrud et al. describes a CMP apparatus that utilizes a multi-head wafer polish assembly with five wafer carriers to simultaneously polish five multiple semiconductor wafers on a single large polishing pad. In operation, five semiconductor wafers are sequentially placed on five loading cups of an index table, which is situated adjacent to the polishing pad. When all of the semiconductor wafers are in place, the loading cups are raised to attach the wafers onto the wafer carriers of the multi-head wafer polish assembly, which are positioned over the loading cups. The multi-head wafer polish assembly is then moved to the polishing pad, where all five semiconductor wafers are polished on the polishing pad. After the polishing, the multi-head wafer polish assembly is transferred back to the index table, where the polished semiconductor wafers are placed on five unloading cups of the index table. The loading cups and the unloading cups are situated on the index table in an alternating fashion, forming a circle of ten loading/unloading cups. The polished semiconductor wafers are then sequentially unloaded from the unloading cups.

A disadvantage of the CMP apparatus of Karlsrud et al. is that a significant amount of time is required to sequentially load new semiconductor wafers onto the loading cups before the wafers can be polished. During this period, the polishing pad remains idle. In addition, similar amount of time is required to sequentially unload polished semiconductor wafers from the unloading cups. Thus, the polishing process of the CMP apparatus of Karlsrud et al. includes substantial idle periods, which potentially decreases the throughput of the apparatus. Furthermore, the index table of the loading and unloading cups occupies a significant amount of space, which increases the footprint of the CMP apparatus.

U.S. Pat. No. 5,738,574 to Tolles et al. describes a CMP apparatus that can simultaneously polish three semiconductor wafers using multiple polishing pads. The CMP apparatus of Tolles et al. includes three polishing stations and a wafer transfer station, which are located at different quadrants about a rotational axis. Each polishing station includes a single polishing pad to polish a semiconductor wafer. The apparatus also includes four wafer carriers that are suspended from a carousel. The carousel is configured to rotate the wafer carriers such that each wafer carrier can be sequentially positioned at each of the four stations. In operation, the three semiconductor wafers on the wafer carriers positioned at the three polishing stations are polished by the polishing pads at the polishing stations. During this period, the semiconductor wafer on the wafer carrier positioned at the wafer transfer station is unloaded and a new semiconductor wafer is loaded onto that wafer carrier. After a predefined polishing period, the wafer carriers are rotated such that each wafer carrier is positioned at a subsequent station. Once the wafer carriers are properly positioned, the three semiconductor wafers at the polishing stations are polished, while the fourth semiconductor wafer at the transfer station is unloaded and a new semiconductor loaded. In this fashion, semiconductor wafers can be continuously processed by the apparatus such that each semiconductor wafer is sequentially polished at the three polishing stations.

Another CMP apparatus that can simultaneously polish multiple semiconductor wafers using multiple polishing pads is described in U.S. Pat. No. 6,136,715 to Shendon et al. The CMP apparatus of Shendon et al. includes a first polishing station, a second polishing station and a wafer transfer station. The first polishing station includes a large polishing pad, while the second polishing station includes a smaller polishing pad. The apparatus also includes multiple wafer carriers that are suspended from a rotatable carousel. In one embodiment, the apparatus includes four wafer carriers. The carousel is configured to rotate the wafer carriers such that each wafer carrier can be sequentially positioned at four locations. Two of the four locations coincide with the transfer station and the second polishing station. The remaining two locations are both at the first polishing station. In operation, the three semiconductor wafers on the wafer carriers positioned at the two polishing stations are polished by the two polishing pads at the polishing stations. Thus, two wafers are polished at the first polishing station. During this period, the semiconductor wafer on the wafer carrier positioned at the wafer transfer station is unloaded and a new semiconductor wafer is loaded onto that wafer carrier. After a predefined polishing period, the wafer carriers are rotated such that each wafer carrier is positioned at a subsequent location. Once the wafer carriers are properly positioned, the three semiconductor wafers at the polishing stations are polished, while the fourth semiconductor wafer at the transfer station is unloaded and a new semiconductor loaded. This cycle is repeated to sequentially polishing additional semiconductor wafers.

A concern with the above-described CMP apparatuses with multiple polishing pads is that the time required to unload a polished semiconductor wafer and then to load a new semiconductor wafer at the wafer transfer station is typically shorter in duration than the polishing time at the polishing stations. Thus, the new semiconductor wafer must remain idle until end of the polishing time. Consequently, valuable processing time is wasted at the transfer station for each semiconductor wafer to be polished.

Another concern with the above-described CMP apparatuses with multiple polishing pads is that the footprint tends to be large due to the use of multiple polishing pads. The size of the polishing pads depends on the size of the semiconductor wafers being polished. Thus, the concern of increased footprint is more significant when polishing 300 μm or larger semiconductor wafers.

Another concern with the above-described CMP apparatuses with multiple polishing pads is that the difficult task of pad conditioning to ensure proper pad profile is compounded by the use of multiple polishing pads.

In view of the above concerns, there is a need for an apparatus and method for chemically and mechanically polishing semiconductor wafers that provides increased efficiency and reduced footprint for the apparatus.

SUMMARY OF THE INVENTION

A chemical mechanical polishing (CMP) apparatus and method for polishing semiconductor wafers utilizes multiple wafer carriers that are transferred to different positions about a polishing pad to polish at least one semiconductor wafer while another semiconductor wafer is being loaded onto or unloaded from one of the wafer carriers. The different positions include multiple polishing positions and one or more loading/unloading positions. In some embodiments, the CMP apparatus is configured such that a semiconductor wafer is polished at a loading/unloading position. The CMP apparatus may also be configured to continuously polish one or more semiconductor wafers while the wafer carriers are being transferred to different positions. Thus, the CMP apparatus can continuously process the semiconductor wafers without significant idle periods. Consequently, in these embodiments, the efficiency of the CMP apparatus is significantly increased. Furthermore, the wafer carriers of the CMP apparatus are preferably restricted to a small area to decrease the footprint of the apparatus.

A CMP apparatus in accordance with the present invention includes a polishing pad having a polishing surface, a number of object carriers that are configured to secure objects to be polished, and a carrier transfer assembly that is configured to sequentially transfer each of the object carriers to different positions on the polishing pad to polish the objects exclusively on the polishing surface of the polishing pad. The carrier transfer assembly is further configured to independently move each of the object carriers such that a first object can be polished by a first object carrier of the object carriers and a second object can be loaded onto a second object carrier of the object carriers in a substantially parallel manner.

The CMP apparatus may also include an object transport device that sequentially transports the objects to be polished to the object carriers when the object carriers are transferred to a first location that is associated with a first position of the different positions. In one embodiment, the object transport device is configured to sequentially transport the objects from the object carriers when the object carriers are situated at the first location, which may laterally coincide with the first position. The CMP apparatus may also include a second object transport device that sequentially transport the objects from the object carriers when the object carriers are transferred to a second location associated with a second position of the different positions. Similar to the first location, the second location may laterally coincide with the second position.

In an embodiment, the polishing pad is a rotatable polishing pad. Furthermore, the object carriers are configured to be separated from the carrier transfer assembly. In this embodiment, the object carriers are transferred to the different positions by the rotatable polishing pad when the object carriers are separated from the carrier transfer assembly and placed on the polishing pad. In this embodiment, the CMP apparatus may include an aligning device that is positioned adjacent to the polishing pad such that the aligning device can contact one of the object carriers to align that object carrier to a desired position of the different positions.

In an embodiment, the polishing pad of the CMP apparatus is a polishing belt having a predefined width that is configured to be moved in a direction substantially perpendicular to the predefined width. In this embodiment, the predefined width of the polishing belt may be sufficiently wide to accommodate the object carriers such that all of the object carriers can be placed on the polishing surface of the polishing belt.

A method of polishing surfaces of objects in accordance to the present invention includes the steps of loading a first object onto a first object carrier, transferring the first object carrier to a first polishing position on a polishing pad, polishing the first object at the first polishing position, loading a second object onto a second object carrier while the first object is approximately positioned at the first polishing position, and transferring the first object carrier and the second object carriers to different polishing positions on the polishing pad such that the first and second objects are exclusively polished on the polishing pad.

In an embodiment, the step of loading the first object onto the first object carrier includes loading the first object onto the first object carrier situated at an object-transport location that coincides with one of the different polishing positions. In this embodiment, the method may further include a step of polishing a prior object secured on the first object carrier at the object-transport location. This step of polishing the prior object and the step of loading the first object onto the first object carriers are executed without transferring the first object carrier to a different polishing position. The method may also include a step of unloading the first object from the first object carrier when the first carrier is transferred back to the object-transport location. Furthermore, the method may include a step of unloading a polished object from the first object carrier at a second object-transport location that is associated with a second polishing position of the different polishing positions.

In an embodiment, the step of transferring the first object and the second object includes rotating the polishing pad about a rotational axis with the first and second object carriers on the polishing pad to transfer the first and second object carriers to the different polishing positions on the polishing pad. In this embodiment, the method may further include a step of extending a stopping device into a rotational path of the first and second object carriers on the polishing pad to align the first and second object carriers at specified positions of the different polishing positions.

Other aspects and advantages of the present invention will become apparent from the following detailed description, taken in conjunction with the accompanying drawings, illustrated by way of example of the principles of the invention.

DETAILED DESCRIPTION OF THE INVENTION

A chemical mechanical polishing (CMP) apparatus in accordance with the present invention includes multiple wafer carriers that are transferred to multiple polishing positions and one or more loading/unloading positions in close proximity to a polishing pad. Consequently, at least one semiconductor wafer can be polished at a polishing position while another semiconductor wafer is loaded or unloaded at a loading/unloading position. In some embodiments, the CMP apparatus is configured such that a semiconductor wafer is polished at a loading/unloading position. The CMP apparatus may also be configured to continuously polish one or more semiconductor wafers as the wafer carriers are being transferred to different polishing positions. Thus, semiconductor wafers can be continuously processed by the CMP apparatus without significant idle periods. Consequently, in these embodiments, the efficiency of the CMP apparatus is significantly increased. Furthermore, the wafer carriers are preferably restricted to a small area to decrease the footprint of the apparatus.

Figure 1:
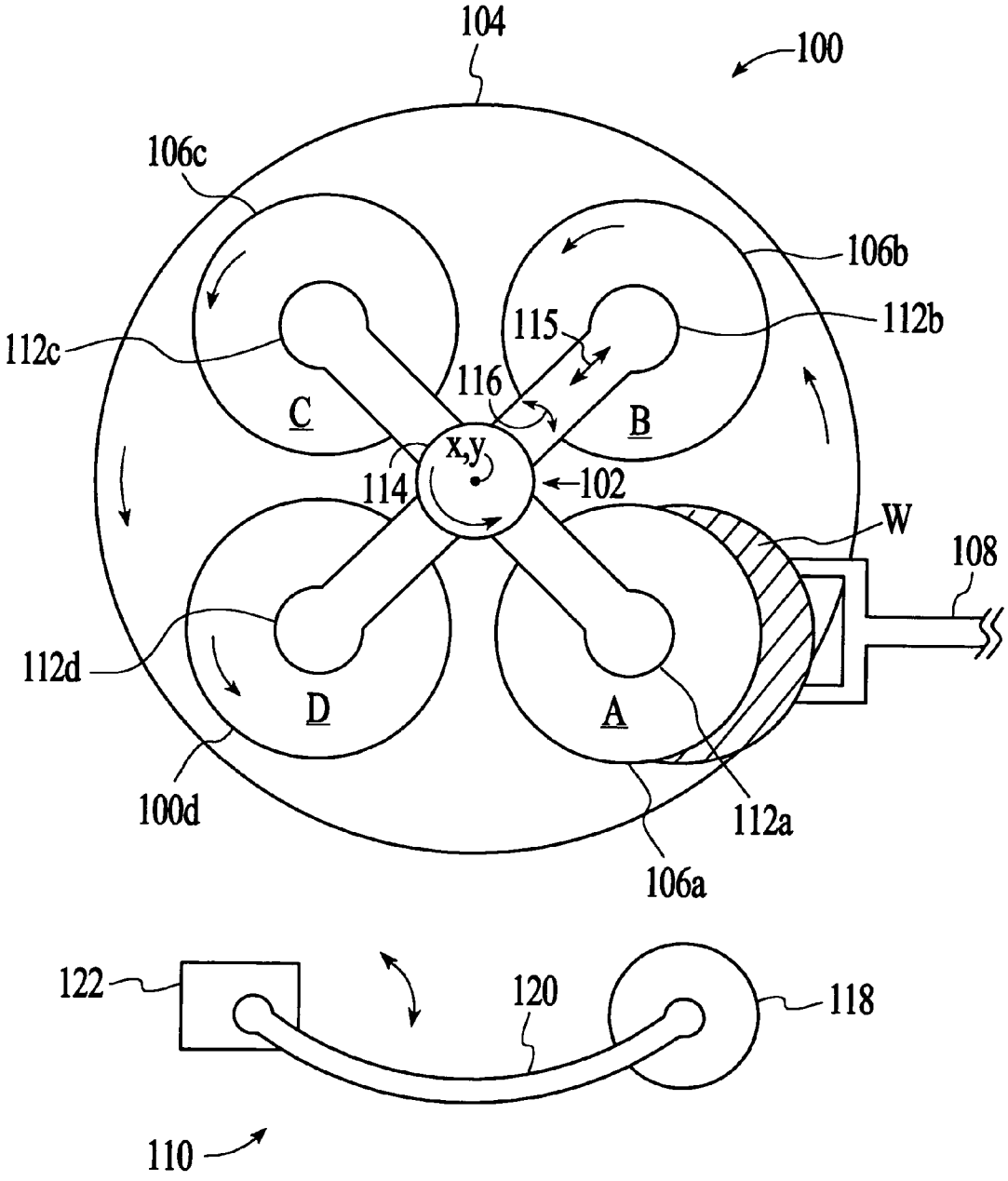
FIG. 1 is a top view of a chemical mechanical polishing (CMP) apparatus with a carrier transfer system in accordance with a first embodiment of the present invention.
Figure 2:
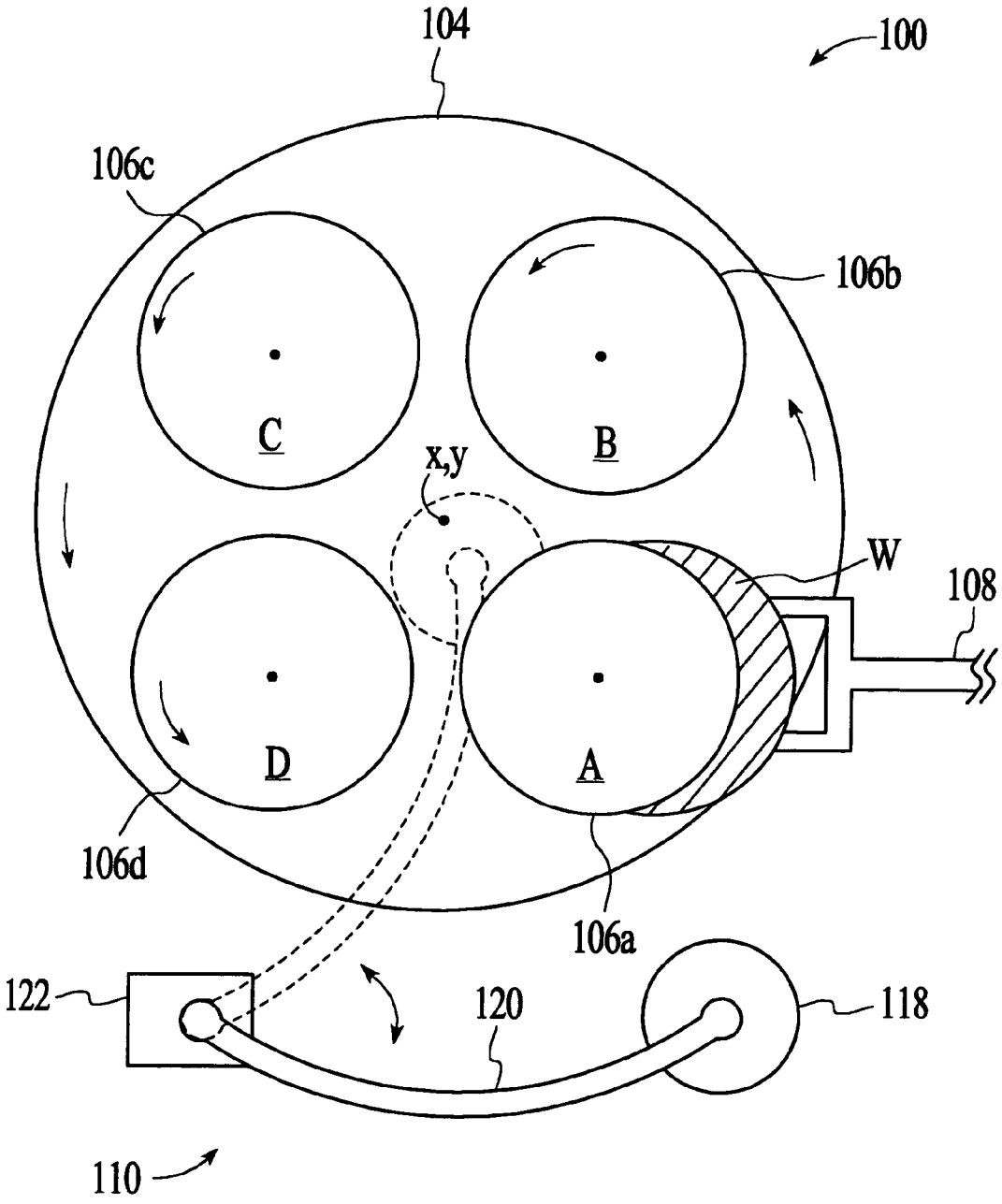
FIG. 2 is a top view of the CMP apparatus of FIG. 1 without the carrier transfer system.
Figure 3:
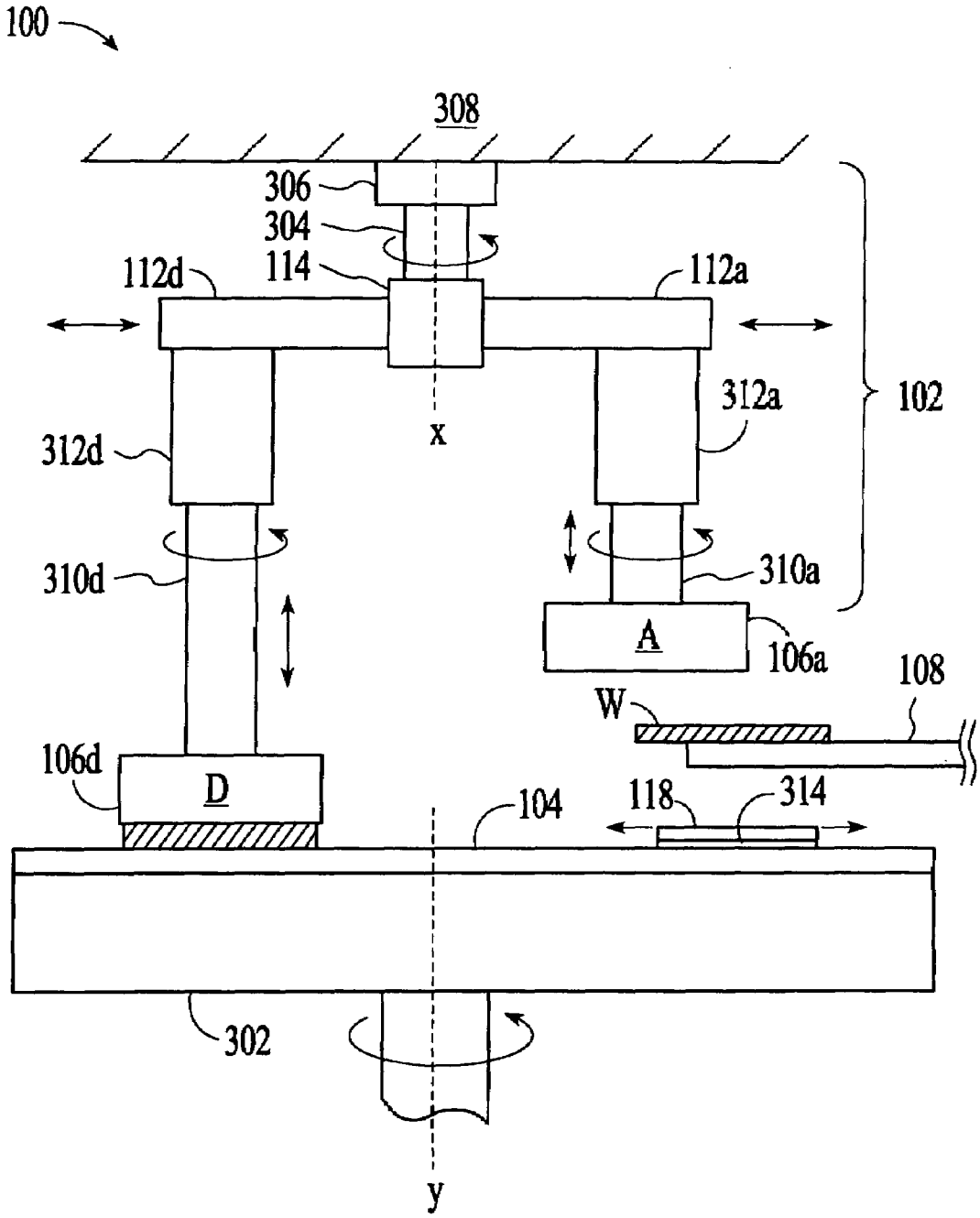
FIG. 3 is a side view of the CMP apparatus of FIGS. 1 and 2.

With reference to FIGS. 1, 2 and 3, a CMP apparatus 100 in accordance with a first embodiment of the present invention is shown. FIG. 1 is a top view of the CMP apparatus with a carrier transfer system 102. FIG. 2 is the same top view as FIG. 1 of the CMP apparatus without the carrier transfer system. FIG. 3 is a side view of the CMP apparatus. The CMP apparatus includes a large polishing pad 104, multiple wafer carriers 106, the carrier transfer system 102, a wafer transport arm 108 and a pad conditioning system 110. The polishing pad is situated on a rotatable base 302, as illustrated in FIG. 3, to rotate the polishing pad. The polishing pad may be any type of polishing pad that can be used to polish a surface of a semiconductor wafer. As an example, the polishing pad may be of the type that contains abrasive particles on the pad surface. The rotatable base may be configured to rotate about the central axis y, which is the center of the rotatable base. Alternatively, rotatable base may be configured to rotate about an off-centered axis. In this alternative embodiment, since the polishing pad is attached to the rotatable base, the polishing pad will also rotate about the off-centered axis such that a given location on the surface of the polishing pad will have an orbital path, about the center of the polishing pad.

The CMP apparatus 100 is shown in FIGS. 1 and 2 as having four wafer carriers 106*a*, 106*b*, 106*c* and 106*d*. However, the CMP apparatus may include two to ten or more wafer carriers. As illustrated, the wafer carriers 106*a*, 106*b*, 106*c* and 106*d* are currently situated at positions A, B, C and D, respectively. The position A is the loading-and-unloading position, where a polished semiconductor wafer is unloaded and a new semiconductor wafer is loaded. The positions B, C and D are polishing positions, where semiconductor wafers are polished on the polishing pad 104. The wafer carriers are supported by the carrier transfer system 102, as illustrated in FIGS. 1 and 3. As is described in more detail below, the carrier transfer system controls the vertical and lateral movements of the wafer carriers with respect to the surface of the polishing pad. The wafer carriers may include passageways that extend to the surfaces of the wafer carriers that contact semiconductor wafers when the wafers are loaded onto the wafer carriers by the wafer transport arm 108. The passageways are used to create a vacuum to secure the wafers onto the wafer carriers.

The carrier transfer system 102 of the CMP apparatus 100 includes four carrier positioning arms 112 that are coupled to an arm control mechanism 114, as shown in FIGS. 1 and 3. The arm control mechanism is coupled to a central shaft 304, which is connected to a rotational drive mechanism 306. The rotational drive mechanism is affixed to an upper surface 308, which may be the housing of the CMP apparatus. Each of the wafer carriers is connected to one of the carrier positioning arms by a carrier shaft 310 and a rotational-and-vertical drive mechanism 312, as illustrated in FIG. 3. In FIG. 3, only the carrier shafts 310*a* and 310*d* and the rotational-and-vertical drive mechanisms 312*a* and 312*d* that are connected to the wafer carriers 106*a* and 106*d* are shown.

Figure 4:
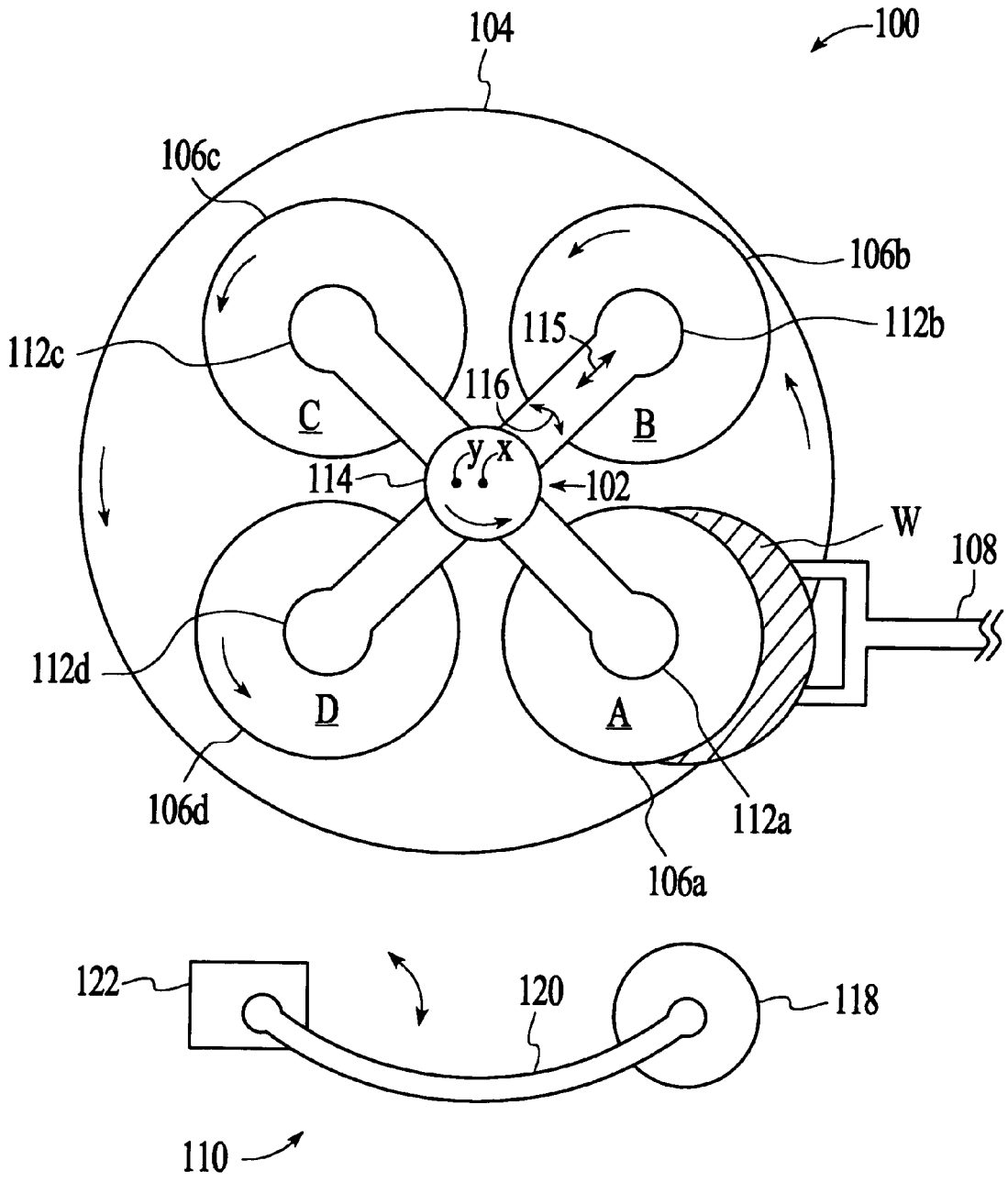
FIG. 4 is top view of the CMP apparatus of FIGS. 1, 2 and 3, in which the central axis of the carrier transfer system is not aligned with the center of the polishing pad.

In operation, the rotational drive mechanism 306 of the carrier transfer system 102 rotates the central shaft 304, which in turn rotates the arm control mechanism 114 and the carrier positioning arms 112 about a central axis x of the carrier transfer system. In FIGS. 1, 2 and 3, the central axis x of the carrier transfer system is shown to be aligned with the centery of polishing pad 104. However, the CMP apparatus 100 may be configured such that the central axis x of the carrier transfer system is not aligned with the centery of the polishing pad, i.e., off-axis, as illustrated in FIG. 4. Although the rotational drive mechanism 306 can rotate the central shaft in either clockwise or counter-clockwise direction, the rotational drive mechanism is illustrated in FIGS. 1 and 3 as rotating the central shaft 304 in the counter-clockwise direction. Currently, the wafer carriers 106*a*, 106*b*, 106*c* and 106*d* are situated at the positions A, B, C and D, respectively. Thus, as illustrated, the wafer carriers can be collectively moved to the adjacent counter-clockwise positions by rotating the central shaft. That is, the wafer carriers 106*a*, 106*b*, 106*c* and 106*d* can be moved to the positions B, C, D and A, respectively, by rotating the central shaft. In this fashion, the wafer carriers can be sequentially moved to the different positions.

The arm control mechanism 114 of the carrier transfer system 102 operates to independently move each of the carrier positioning arms 112 such that the wafer carriers 106 can be swept over the polishing pad 104 in two degrees of freedom. The arm control mechanism is configured to extend and to retract each of the carrier positioning arms 112 independently along a radial direction of the polishing pad, as indicated by the arrow 115 in FIG. 1. In addition, the arm control mechanism is configured to pivot each of the carrier positioning arms independently about the arm control mechanism in a substantially perpendicular direction with respect to the radial direction, as indicated by the arrow 116. In an alternative embodiment, the carrier positioning arms may be rigidly attached to the arm control mechanism. Thus, in this embodiment, the arm control mechanism does not independently move each of the carrier positioning arms as indicated by the arrows 115 and 116.

Each rotational-and-vertical drive mechanism 312 of the carrier transfer system 102 operates to individually rotate the carrier shaft 310 coupled to that rotational-and-vertical drive mechanism. Thus, the wafer carriers 106 may be individually rotated at different rotational speeds. In addition, each rotational-and-vertical drive mechanism operates to individually move the coupled carrier shaft along the vertical direction to lower or raise the wafer carrier connected to that carrier shaft. Thus, the rotational-and-vertical drive mechanism controls the individual pressure of the semiconductor wafers on the wafer carriers against the polishing pad 104, which affects the amount of polishing of the semiconductor wafers.

As illustrated in FIGS. 1, 2 and 3, the wafer carrier 106*a* at the position A is being loaded with a new semiconductor wafer W by the wafer transport arm 108. The wafer transport arm operates to sequentially load new semiconductor wafers onto the wafer carriers 106 when the wafer carriers are transferred to the position A. The new semiconductor wafers may be from a wafer cartridge (not shown) that has a supply of semiconductor wafers to be polished. The wafer transport arm also operates to unload polished semiconductor wafers from the wafer carriers when the wafer carriers are transferred back to the position A.

The pad conditioning system 110 of the CMP apparatus 100 includes a pad conditioner 118 that is attached to a curved arm 120. As shown in FIG. 3, the surface 314 of the pad conditioner may include known pad conditioning material, such as embedded diamond particulates or plastic bristles, to deglaze the surface of the polishing pad 104. The curved arm is connected to a pivoting drive mechanism 122, which controls the lateral movement of the pad conditioner with respect to the surface of the polishing pad, as well as the vertical movement of the pad conditioner. The pad conditioning system also includes a rotational drive mechanism (not shown) that rotates the pad conditioner when the pad conditioner is engaged with the polishing pad to condition the polishing surface of the pad. In operation, the pivoting drive mechanism pivots the curved arm so that the pad conditioner is laterally moved across the polishing pad, as illustrated in FIG. 2. When the pad conditioner is over the polishing pad, the pivoting drive mechanism may also lower the pad conditioner to ensure that sufficient pressure is being applied onto the polishing pad by the pad conditioner for proper conditioning. The curvature of the curved arm of the pad conditioning system prevents the curved arm from colliding with the wafer carrier 106 at the position D as the pad conditioner is swept to the center of the polishing pad, as shown in FIG. 2.

The CMP apparatus 100 polishes semiconductor wafers in phases, as described below. Since the CMP apparatus includes four wafer carriers 106 that can be transferred to four different positions A, B, C and D, the polishing process includes four phases to polish a single semiconductor wafer. Each phase lasts a predefined period. The polishing process begins and ends at the position A. At the position A, a polished semiconductor is unloaded from a wafer carrier 106 and a new semiconductor wafer is loaded to that wafer carrier. The new semiconductor wafer is then polished at the position A until the end of the predefined period. At each of the positions B, C and D, a semiconductor wafer is further polished for the entire predefined period.

Figure 5:
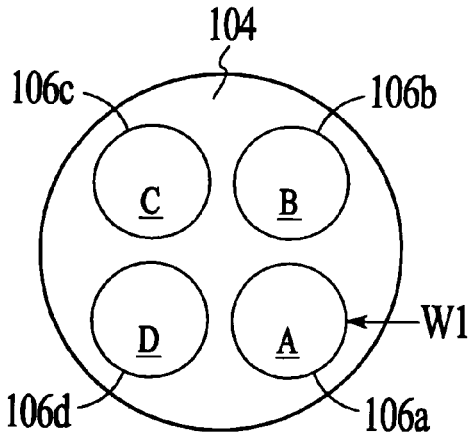
FIGS. 5–9 illustrate the operation of the CMP apparatus of FIGS. 1, 2 and 3.
Figure 6:
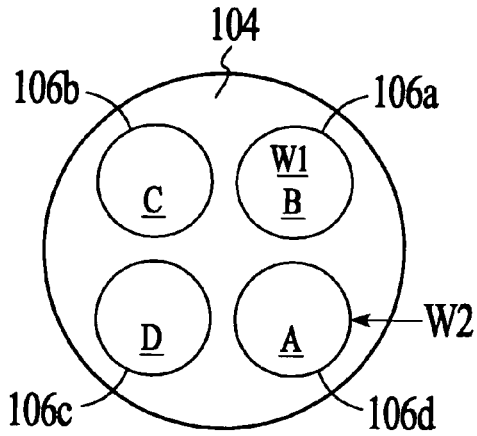
Figure 7:
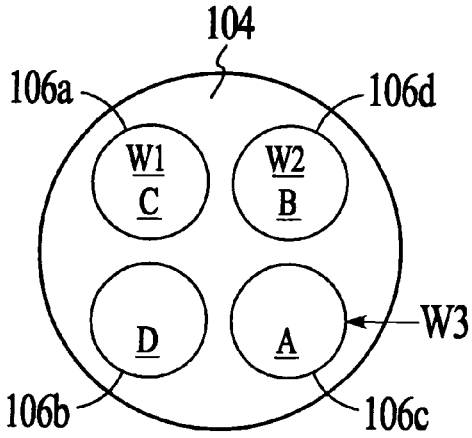
Figure 8:
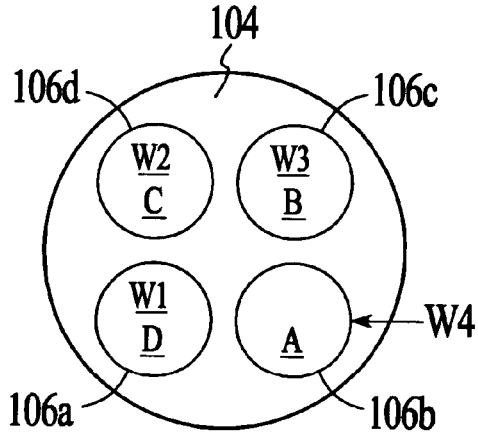
Figure 9:
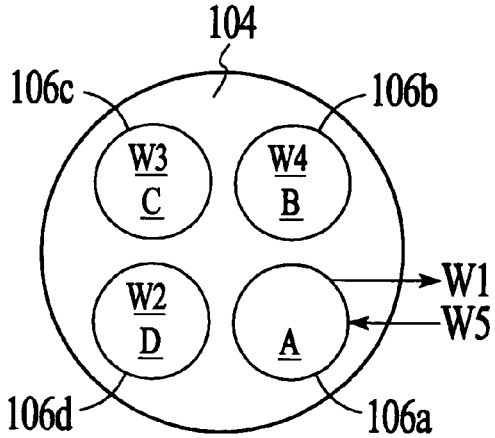

The operation of the CMP apparatus 100 is described with reference to FIGS. 5, 6, 7, 8 and 9. The carrier transfer system 102 and the wafer transport arm 108 are not shown in FIGS. 5–9. During a first phase, a semiconductor wafer W1 is loaded onto the wafer carrier 106*a* at the position A by the transport arm, as illustrated in FIG. 5. After the semiconductor wafer W1 is loaded, the wafer carrier 106*a* is lowered so that the wafer W1 contacts the polishing pad 104 to begin polishing. At the end of the predefined period, the wafer carriers 106 are then transferred by the carrier transfer system so that the wafer carrier 106*a* is now situated at the position B, as illustrated in FIG. 6, which begins the next phase. During a second phase, the semiconductor wafer W1 is further polished at the position B by the wafer carrier 106*a*. Meanwhile, the wafer carrier 106*d*, now at position A, is loaded with a second semiconductor wafer W2 by the wafer transport arm. The semiconductor wafer W2 is then lowered to begin polishing. After another predefined period, the wafer carriers are then transferred by the carrier transfer system so that the wafer carrier 106*a* is now situated at position C, as illustrated in FIG. 7, which begins the next phase. During a third phase, the semiconductor wafers W1 and W2 are further polished at the positions C and B, respectively. The wafer carrier 106*c*, now at the position A, is loaded with a third semiconductor wafer W3 by the wafer transport arm. The semiconductor wafer W3 is then lowered to begin polishing. After another predefined period, the wafer carriers are then transferred by the carrier transfer system so that the wafer carrier 106*a* is now situated at the position D, as illustrated in FIG. 8, which begins the next phase. During a fourth phase, the semiconductor wafers W1, W2 and W3 are further polished at the positions D, C and B, respectively. The wafer carrier 106*b*, now at position A, is loaded with a fourth semiconductor wafer W4 by the wafer transport arm. The semiconductor wafer W4 is then lowered to begin polishing. After another predefined period, the wafer carriers are then transferred by the carrier transfer system so that the wafer carrier 106*a* is now back at the position A, as illustrated in FIG. 9, which begins the next phase. At this point, the semiconductor wafer W1 has been polished at each of the positions A, B, C and D, which completes the polishing process for the wafer W1.

During this next phase, the semiconductor wafers W2, W3 and W4 on the wafer carriers 106*d*, 106*c* and 106*b* are further polished at the positions D, C and B, respectively. Meanwhile, the semiconductor wafer W1 is unloaded from the wafer carrier by the wafer transport arm. After the wafer W1 is unloaded, a fifth semiconductor wafer W5 is loaded onto the wafer carrier 106*a*, and the process is continued. In this fashion, three semiconductor wafers are continuously polished at each of the positions B, C and D, as semiconductor wafers are loaded, unloaded and polished at the position A.

Since the semiconductor wafers are exclusively polished on the single polishing pad 104, the wafers can be continuously polished during the transfer of the wafer carriers 106 to the subsequent positions. Thus, the semiconductor wafers do not have to be lifted when the wafer carriers are being transferred to the subsequent positions, which would be the case if one or more of the positions A, B, C and D are located on a different polishing pad. Consequently, the entire processing time of the CMP apparatus 100 is significantly reduced, when compared a conventional CMP apparatus with multiple polishing pads. In addition, since the semiconductor wafers are in contact with the polishing pad during the entire polishing process, the semiconductor wafers are ensured to remain attached to the wafer carriers during the entire polishing process.

In an alternative embodiment, the polishing of a semiconductor wafer on a wafer carrier at the position A is performed before unloading and loading. Thus, in this embodiment, the last polishing step for a semiconductor wafer is performed when the wafer carrier is transferred back to the position A. Consequently, the first polishing step for the semiconductor wafer is performed when the wafer is transferred to the position B.

Concurrent to the loading, unloading and polishing of the semiconductor wafers, the polishing pad 104 is conditioned by the pad conditioning system 110. As the wafer carrier at the position A is unloaded of the polished semiconductor wafer and is loaded with a new semiconductor wafer, the pad conditioner 118 is swept across the polishing pad to condition the pad, as illustrated in FIGS. 2 and 3. The polishing pad may be conditioned during each phase of the polishing process. That is, the polishing pad is conditioned every time a polished semiconductor wafer is unloaded and a new semiconductor wafer is loaded. Alternatively, the polishing pad may be conditioned less frequently. As an example, the conditioning of the polishing pad may occur every third phase. The frequency of the pad conditioning may be adjusted as needed.

Figure 10:
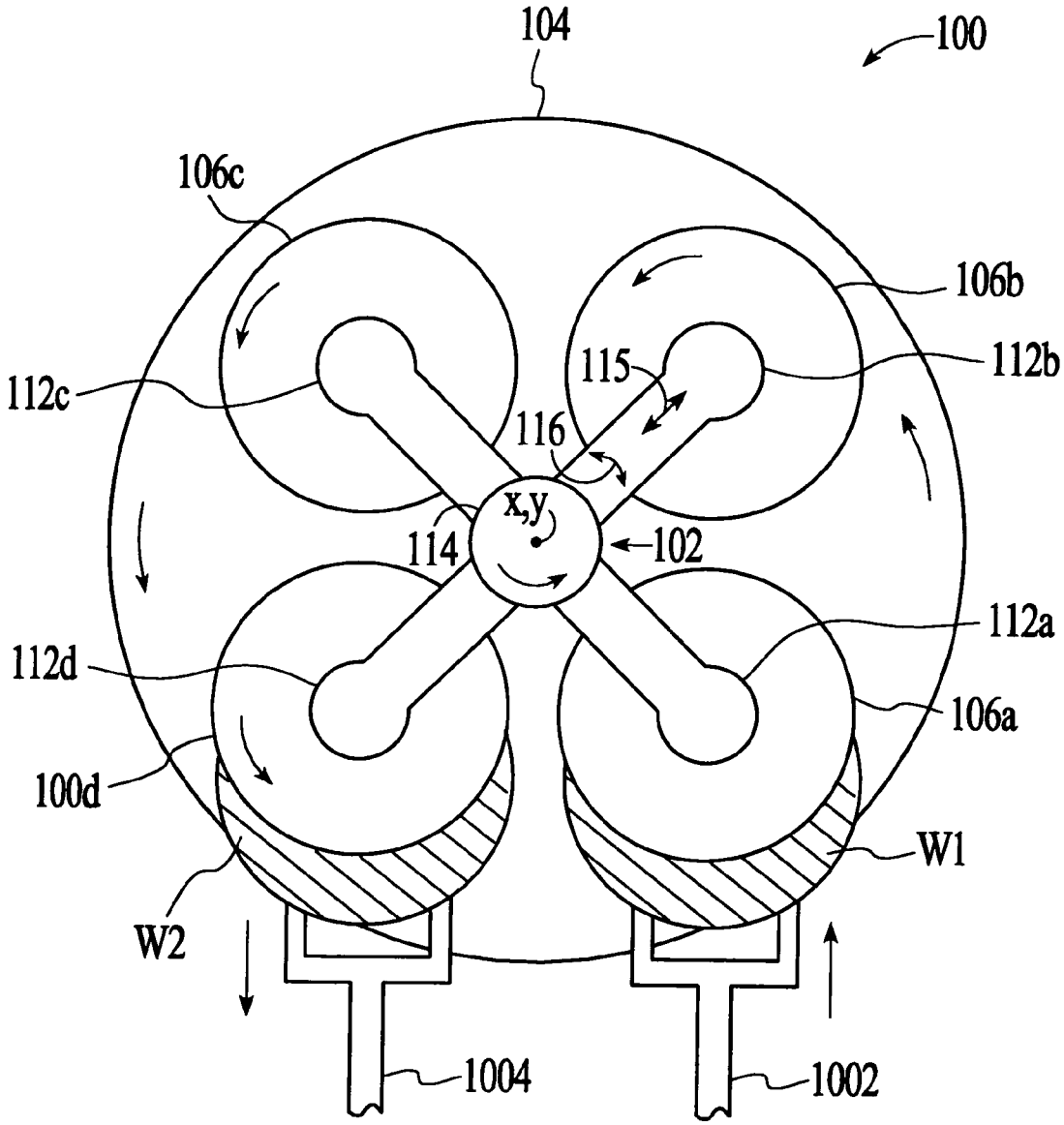
FIG. 10 is a top view of the CMP apparatus of FIGS. 1, 2 and 3 in accordance with an alternative embodiment of the present invention.

In an alternative embodiment, the CMP apparatus 100 includes two wafer transport arms 1002 and 1004, as illustrated in FIG. 10. In this alternative embodiment, the wafer transport arm 1002 is used exclusively to load semiconductor wafers, e.g., the semiconductor wafer W1, onto the wafer carriers 106 when the wafer carriers are transferred to the position A. Similarly, the wafer transport arm 1004 is used exclusively to unload polished semiconductor wafers, e.g., the semiconductor wafer W2, from the wafer carriers when the wafer carriers are transferred to the position D.

In operation, a given semiconductor wafer, e.g., the semiconductor wafer W1, is loaded onto one of the wafer carriers 106 at the position A, e.g., the wafer carrier 106*a*, by the wafer transport arm 1002. The loaded semiconductor wafer is then polished by the wafer carrier 106*a* at the position A. Next, the semiconductor wafer W1 is continuously polished as the wafer carrier 106*a* is transferred to the positions B, C and D by the carrier transfer system 102. When the wafer carrier 106*a* is transferred to a new position, another semiconductor wafer is loaded onto the wafer carrier at the position A by the wafer transport arm 1002. After the semiconductor wafer W1 has been further polished at the position D, the wafer is unloaded from the wafer carrier 106*a* by the wafer transport arm 1004. The wafer carrier 106*a* is then transferred back to the position A, where a new semiconductor wafer is loaded onto the wafer carrier 106*a*, and the process is repeated.

Figure 11:
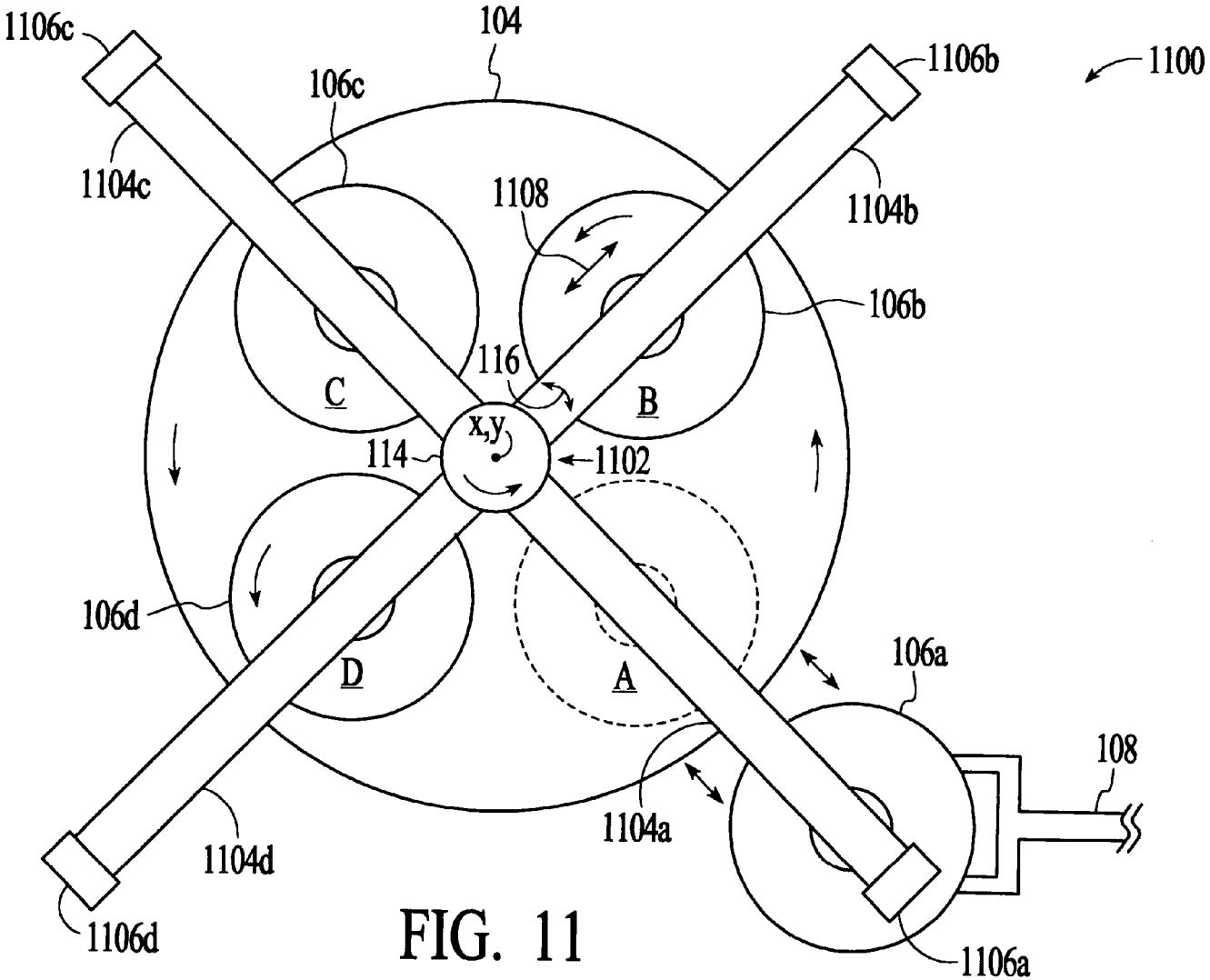
FIG. 11 is a top view of a CMP apparatus in accordance with a second embodiment of the present invention.
Figure 12:
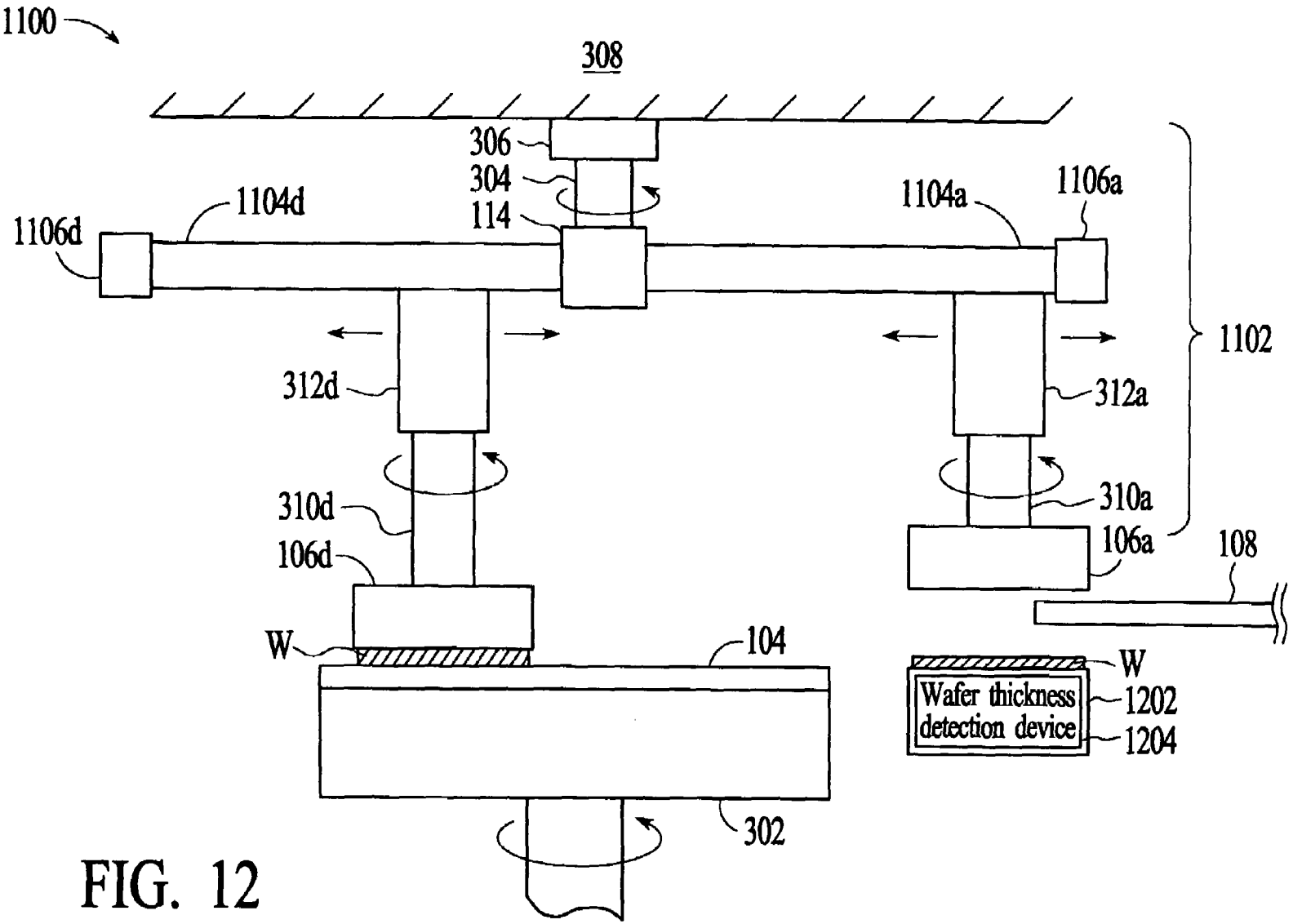
FIG. 12 is a side view the CMP apparatus of FIG. 11.

In FIGS. 11 and 12, a CMP apparatus 1100 in accordance with a second embodiment is shown. FIG. 11 is a top view of the CMP apparatus, while FIG. 12 is a side view of the CMP apparatus. In this embodiment, the CMP apparatus further includes a wafer unload/load cup unit 1202, which is situated adjacent to the wafer pad 104, as shown in FIG. 12. The wafer unload/load cup unit operates as a transfer station for the wafer carriers 106 to load and unload semiconductor wafers. The semiconductor wafers are transported to and from the wafer unload/load cup unit by the wafer transport arm 108. The wafer unload/load cup unit may include an optional wafer thickness detection device 1204 to measure the thickness of semiconductor wafers as the wafers are being transferred between the wafer transport arm and the wafer carriers. Such a device is well known in the field of semiconductor processing and thus, the operation of the wafer thickness detection device is not described herein. The wafer thickness detection device can measure the thickness of a given semiconductor wafer before and after the polishing process. Thus, the wafer thickness detection device can provide information about how much of the semiconductor wafer has been polished during the entire process. The information can then be used by a microcontroller (not shown) of the CMP apparatus to change the polishing parameters of the apparatus, such as the polishing time, the amount of pressure applied to the semiconductor wafers and the rotational speed of the wafer carriers. For example, if the difference between the original thickness of a semiconductor wafer and the polished thickness of the wafer is below a desired value, one or more polishing parameters may be adjusted to increase the amount of polishing performed on the semiconductor wafers that are currently being polished or on the semiconductor wafers to be polished.

In order to move the wafer carriers 106 from the wafer unload/load cup unit 1202 to the polishing pad 104, the CMP apparatus 1100 includes a wafer transfer system 1102 that differs from the wafer transfer system 102 of the CMP apparatus 100 of FIGS. 1, 2 and 3. The wafer transfer system 1102 includes carrier positioning arms 1104 that extend further than the carrier positioning arms 112 of the wafer transfer system 102. In addition, the wafer transfer system 1102 includes carrier displacement motors 1106, which are attached to the ends of the carrier positioning arms, as shown in FIG. 11. In this embodiment, the carrier positioning arms 1104 include rails (not shown) that allow the wafer carriers 106 to be displaced along their respective carrier positioning arms by the carrier displacement motors. Thus, the wafer carriers can be displaced between the position A and the wafer unload/load cup unit by the carrier displacement motors, as illustrated in FIG. 11. Furthermore, the carrier displacement motors can radially oscillate the wafer carriers during wafer polishing, as indicated by the arrow 1108, to sweep the polishing pad 104. Thus, in this embodiment, the arm control mechanism 114 need not perform the task of sweeping the polishing pad by extending and retracting the carrier positioning arms. Although not shown in FIGS. 11 and 12, the CMP apparatus 1100 may also include the pad conditioner 118.

The operation of the CMP apparatus 1100 is similar to the CMP apparatus 100 of FIGS. 1, 2 and 3. The only significant difference is that the wafer carriers 106 are transferred between the wafer unload/load cup unit 1202 and the position A to unload polished semiconductor wafers and to acquire new semiconductor wafers. In one embodiment, the wafer transport arm 108 exclusively transports the semiconductor wafers to and from the wafer unload/load cup unit. Thus, in this embodiment, a polished semiconductor wafer on the wafer carrier situated over the wafer unload/load cup unit is unloaded onto the wafer unload/load cup unit by that wafer carrier. Furthermore, when the polished semiconductor wafer is removed from the wafer unload/load cup unit and a new semiconductor wafer is placed on the wafer unload/load cup unit by the wafer transport arm, the new wafer is picked up by the same wafer carrier. In another embodiment, the wafer transport arm transports the semiconductor wafers to and from the wafer unload/load cup unit and also transports the wafers between the wafer unload/load cup unit and the wafer carriers. Thus, in this embodiment, the wafer carriers do not directly unload polished semiconductor wafers onto the unload/load cup unit and do not directly load new semiconductor wafers from the unload/load cup unit. If the wafer unload/load cup unit includes the optional wafer thickness detection device, the wafer unload/load cup unit measures the thickness of polished semiconductor wafers and new semiconductor wafers placed on the unload/load cup unit, which can then be used to adjust one or more polishing parameters.

Figure 13:
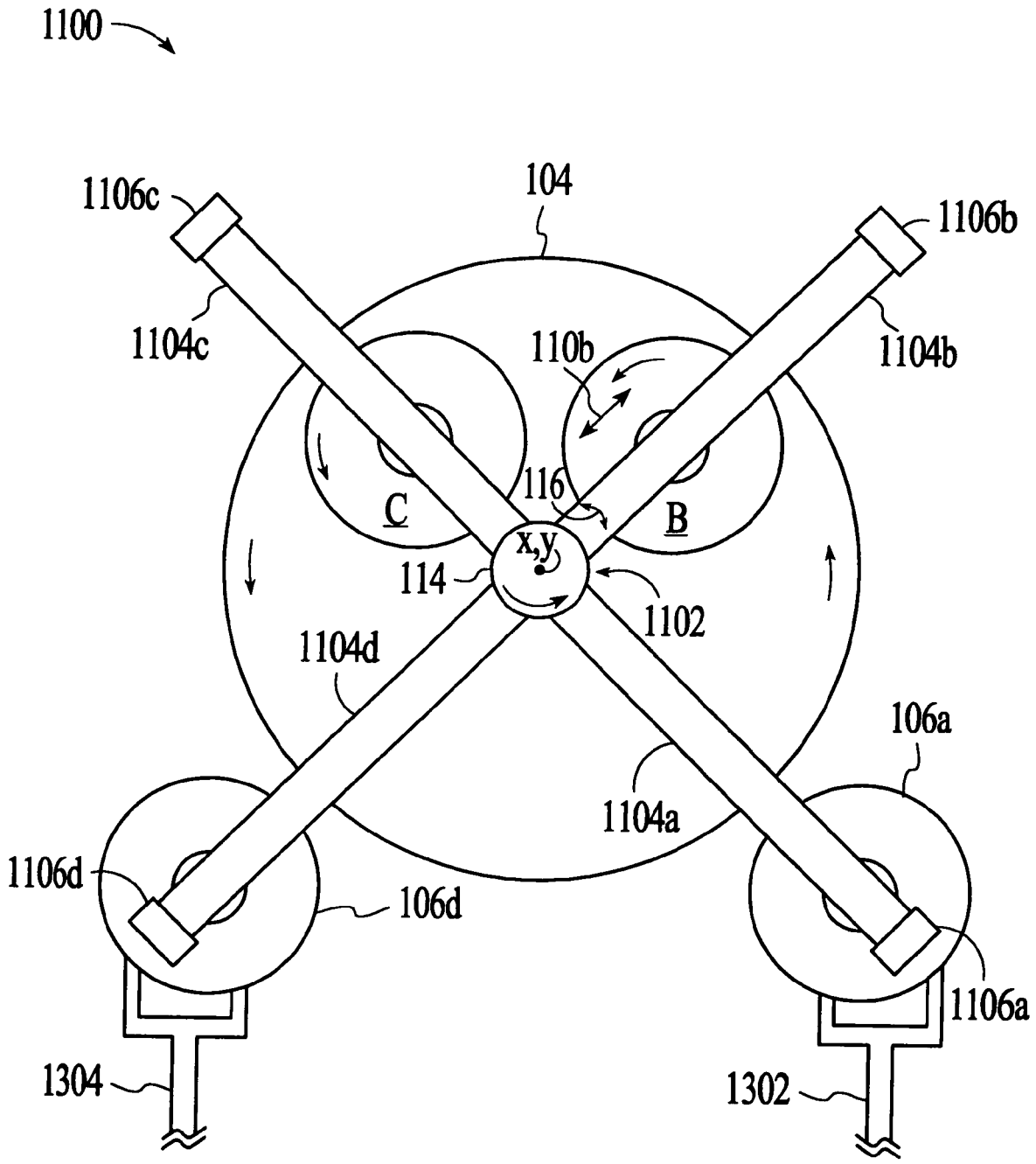
FIG. 13 is a top view of a CMP apparatus in accordance with an alternative embodiment of the CMP apparatus of FIGS. 11 and 12.
Figure 14:
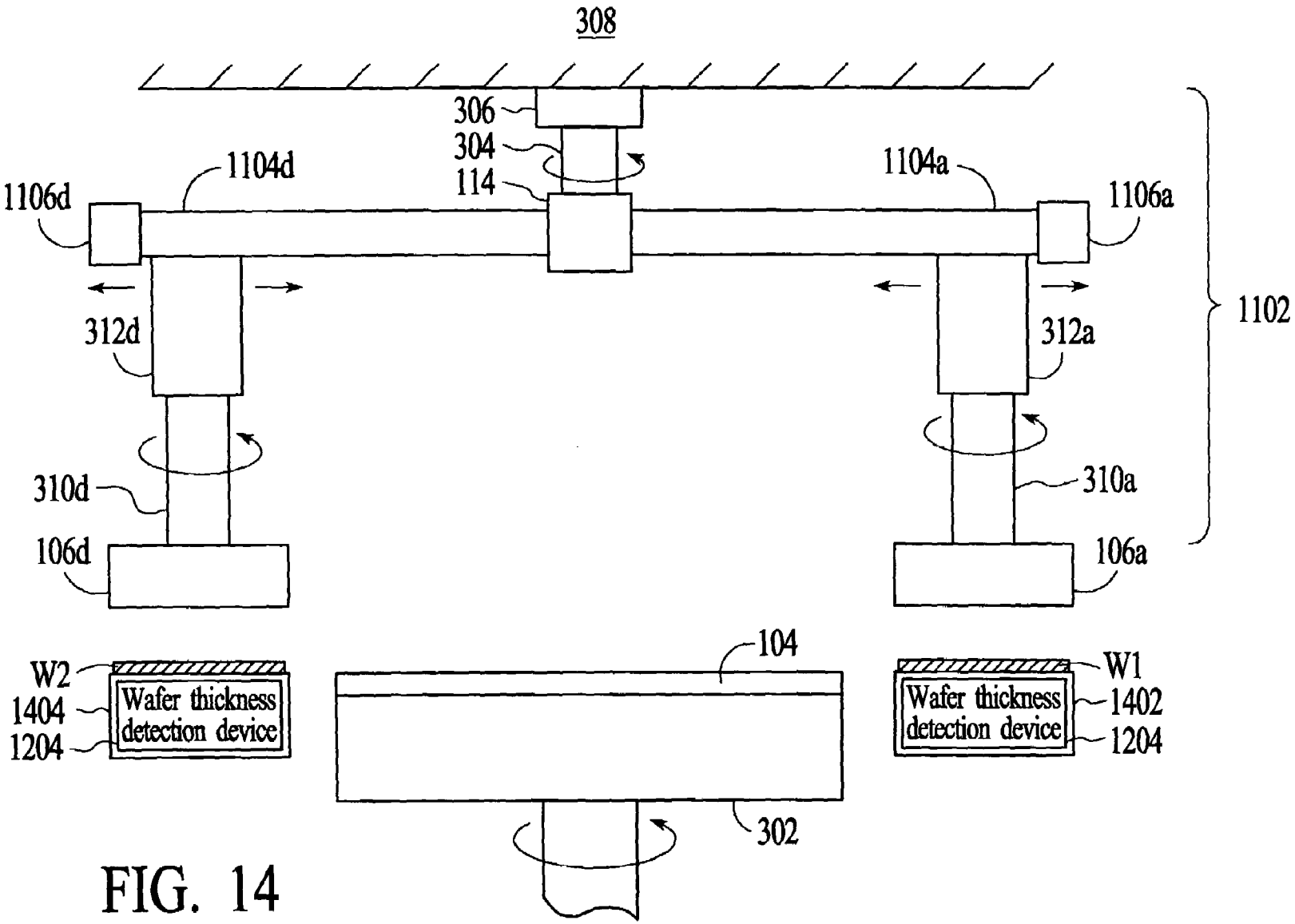
FIG. 14 is a side view the CMP apparatus of FIG. 13.

In an alternative embodiment, the CMP apparatus 1100 includes a wafer load cup unit 1402, a wafer unload cup unit 1404 and two wafer transport arms 1302 and 1304, as illustrated in FIGS. 13 and 14. In this alternative embodiment, the wafer transport arm 1302 is used exclusively to load semiconductor wafers, e.g., the semiconductor wafer W1, onto the wafer load cup unit 1402. Similarly, the wafer transport arm 1304 is used exclusively to unload polished semiconductor wafers, e.g., the semiconductor wafer W2, from the wafer unload cup unit 1404. Each of the wafer load and unload cup units may include the optional wafer thickness detection device 1204 to measure the thickness of semiconductor wafers before and after the polishing process.

Figure 15:
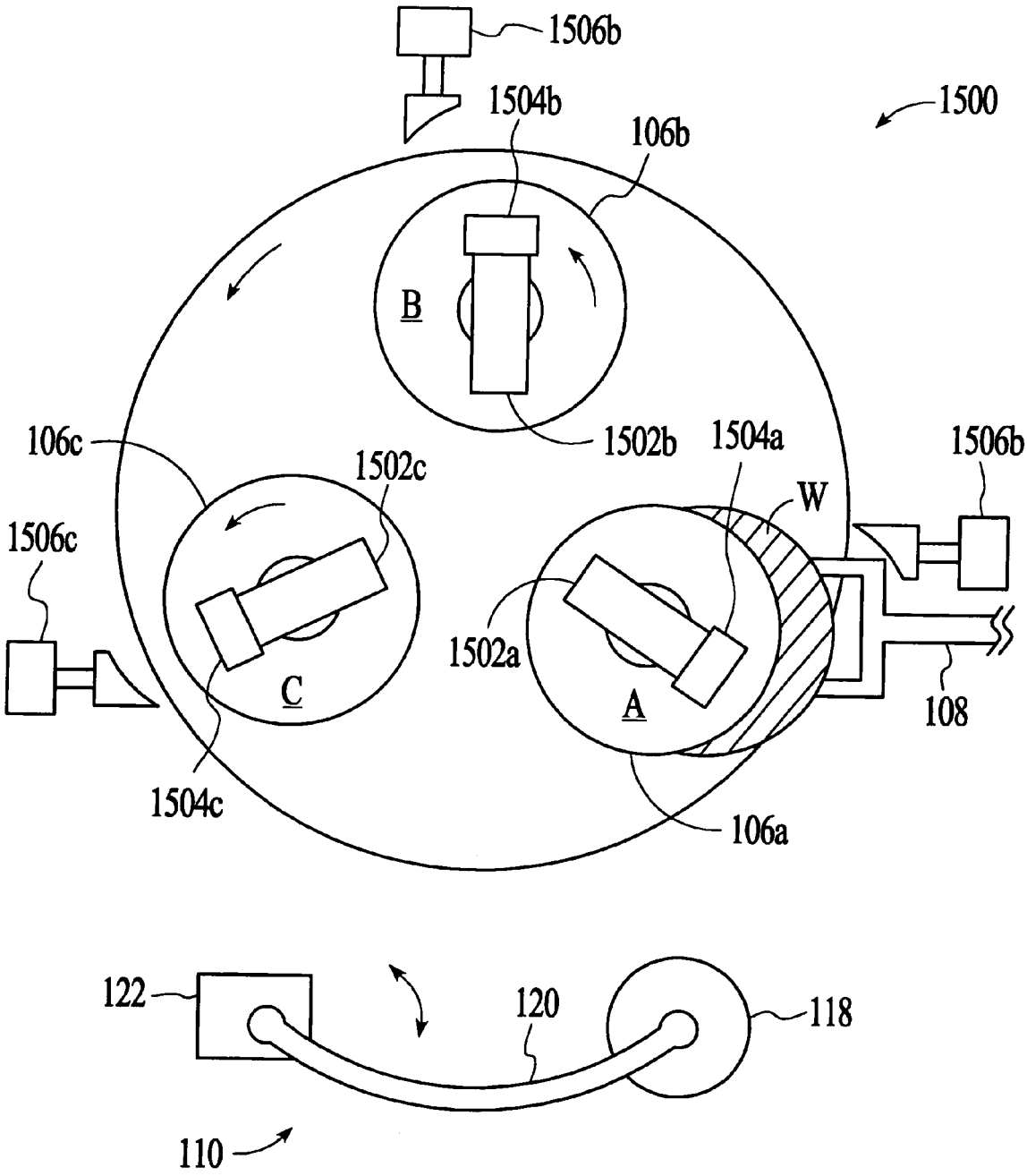
FIG. 15 is a top view of a CMP apparatus in accordance with a third embodiment of the present invention.
Figure 16:
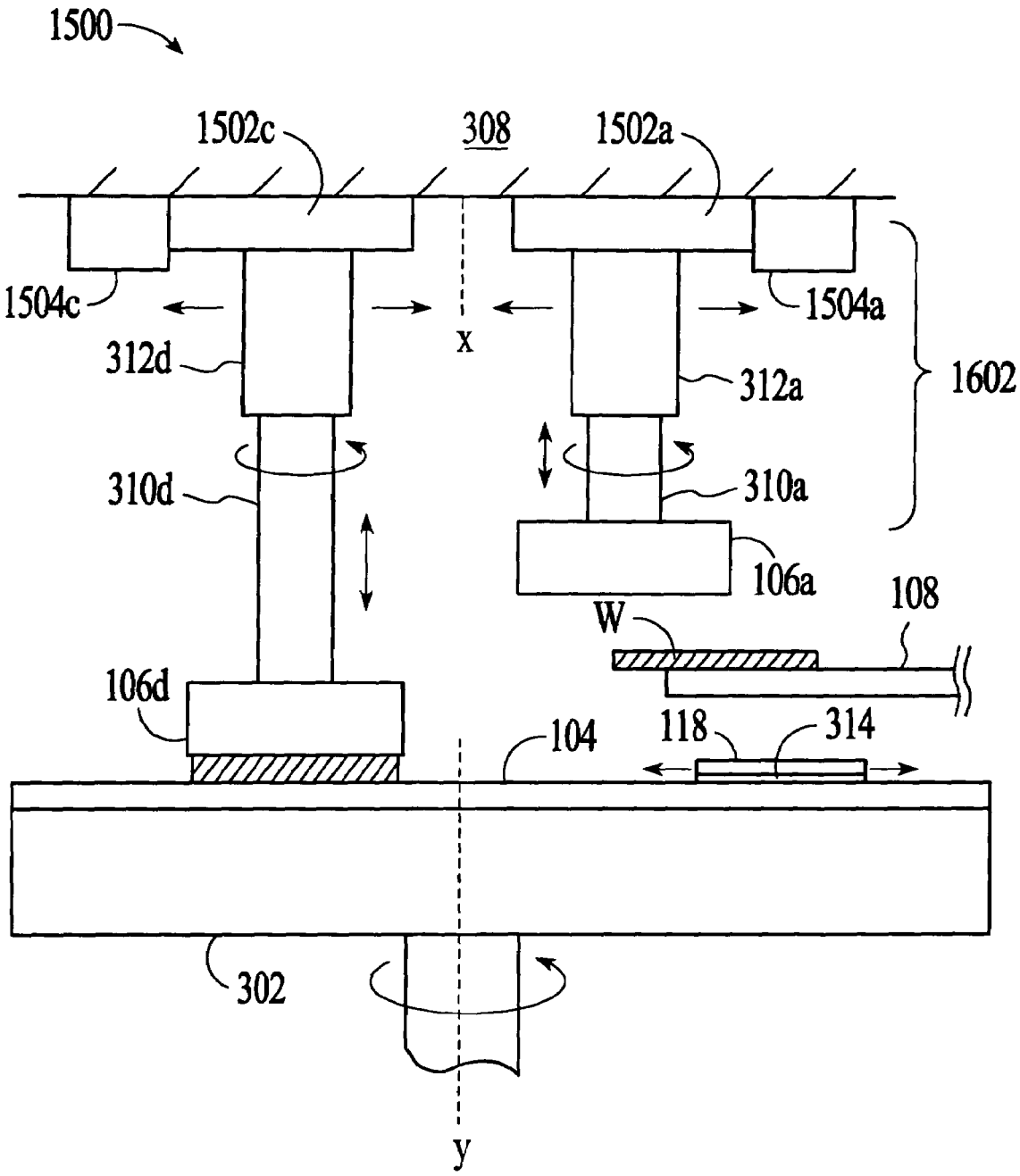
FIG. 16 is a side view the CMP apparatus of FIG. 15.

Turning to FIGS. 15 and 16, a CMP apparatus 1500 in accordance with a third embodiment of the invention is shown. FIG. 15 is a top view of the CMP apparatus, while FIG. 16 is a side view of the CMP apparatus. The CMP apparatus is shown to include only three wafer carriers 106 that are situated at the positions A, B and C. However, similar to the CMP apparatus 100 of the first embodiment, the CMP apparatus 1500 can be configured to include two to ten or more wafer carriers. The CMP apparatus 1500 includes most of the components of the CMP apparatus 100 of FIGS. 1, 2 and 3. The CMP apparatus 1500 includes the polishing pad 104, the base 302, the wafer carriers 106, the wafer transport arm 108, and the pad conditioning system 110. However, the CMP apparatus 1500 includes a carrier transfer system 1602 that differs from the carrier transfer system 102 of the CMP apparatus 100.

In this embodiment, the carrier transfer system 1602 includes short carrier positioning arms 1502 and carrier displacement motors 1504 that are connected to the upper surface 308, as illustrated in FIGS. 15 and 16. The carrier positioning arms include rails (not shown) that allow the wafer carriers 106 to be displaced along their respective carrier positioning arms by the carrier displacement motors so that the wafer carriers can sweep the polishing pad 104 during wafer polishing. The rotational-and-vertical drive mechanisms 312 are connected directly to the carrier positioning arms 1502, as illustrated in FIG. 16. Thus, the rotational-and-vertical drive mechanisms and the connected carrier shafts 310 do not rotate about the central axis x to transfer the wafer carriers 106 to the different positions. Instead, the carrier transfer system of the CMP apparatus 1500 utilizes the polishing pad 104 to rotate each wafer carrier from one position to the next. Consequently, the carrier shafts 310 and the wafer carriers are structurally designed to be separated so that the rotation of the polishing pad can transfer the wafer carriers to different positions. As an example, each wafer carrier may be selectively attached to the respective carrier shaft by a vacuum. The wafer carrier then may be separated from the carrier shaft by removing the vacuum. Alternatively, each wafer carrier may be selectively attached to the respective carrier shaft by an interlocking mechanism (not shown). When the wafer carriers are separated from the carrier shafts and situated on the polishing pad, the wafer carriers can be transferred to different positions by rotating the polishing pad. At their new positions, the wafer carriers are then be connected to different wafer shafts. The positioning of the wafer carriers is described in detail below.

Figure 17:
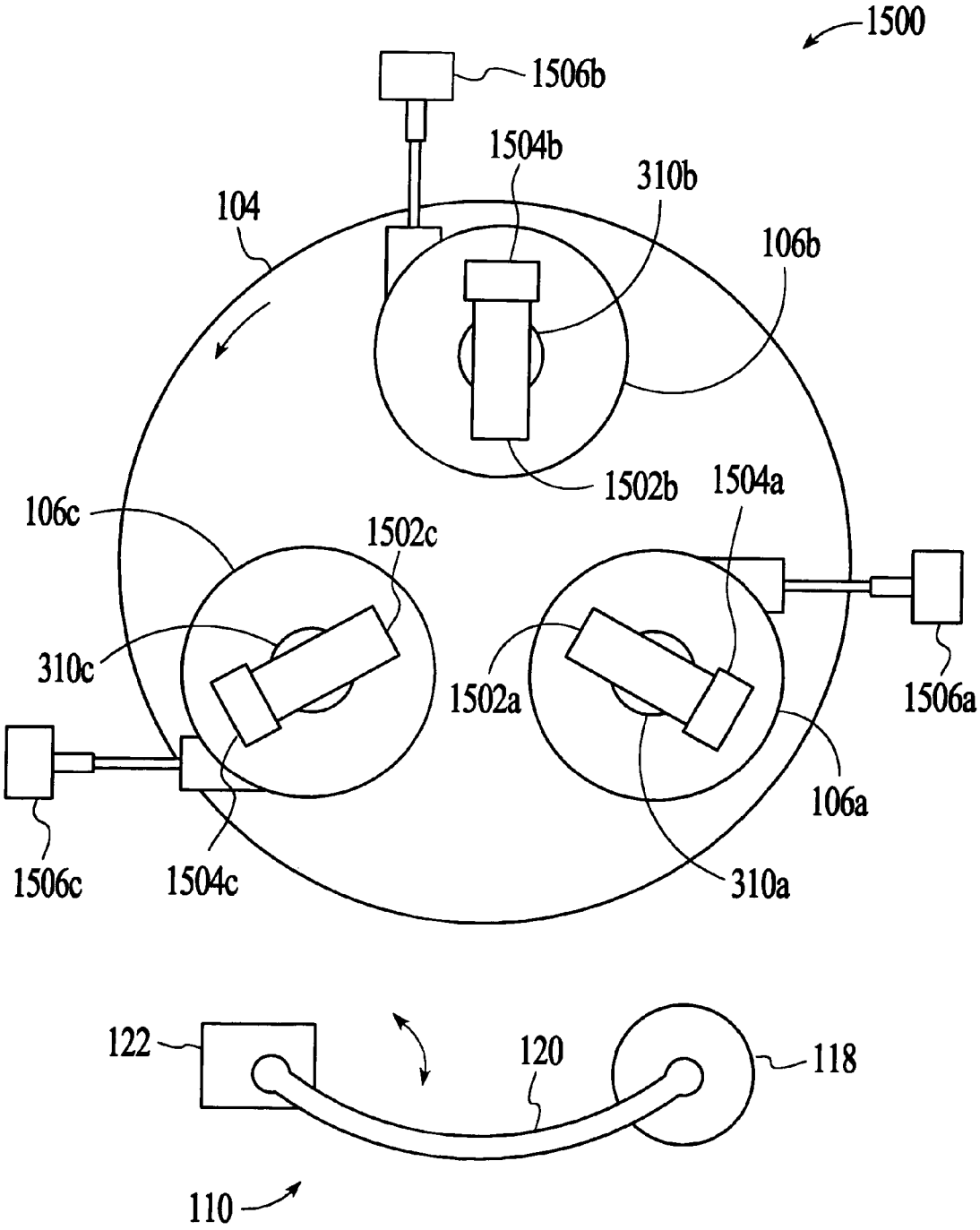
FIG. 17 is a top view of the CMP apparatus of FIGS. 15 and 16, in which the aligners of the apparatus are extended.

As shown in FIG. 15, the CMP apparatus 1500 further includes aligners 1506 that operate to align the separated wafer carriers 106 when the wafer carriers are being transferred from their current positions to their next positions by the polishing pad 104. The aligners are not illustrated in FIG. 16. When retracted, the aligners do not interfere with the separated wafer carriers on the polishing pad, which allows the polishing pad to be rotated, as illustrated in FIG. 15. However, when extended, the aligners contact the separated wafer carriers on the rotating polishing pad, which aligns the wafer carriers to their new positions, as illustrated in FIG. 17. The aligners are located around the periphery of the polishing pad such that the separated wafer carriers are aligned at the positions A, B and C when the wafer carriers contact the aligners. Thus, the aligners can accurately stop the separated wafer carriers at their next positions.

Similar to the CMP apparatus 100 of the first embodiment, the CMP apparatus 1500 polishes semiconductor wafers in phases, as described below. Since the CMP apparatus 1500 includes only three wafer carriers 106 that can be transferred to three positions, the polishing process for a semiconductor wafer includes three phases. Each phase lasts a predefined period. The position A begins and ends the polishing process. At the position A, a polished semiconductor is unloaded from a wafer carrier and a new semiconductor wafer is loaded to that wafer carrier. The new semiconductor wafer is then polished at the position A until the end of the predefined period. At each of the positions B and C, a given semiconductor wafer is further polished for the entire predefined period.

Figure 18:
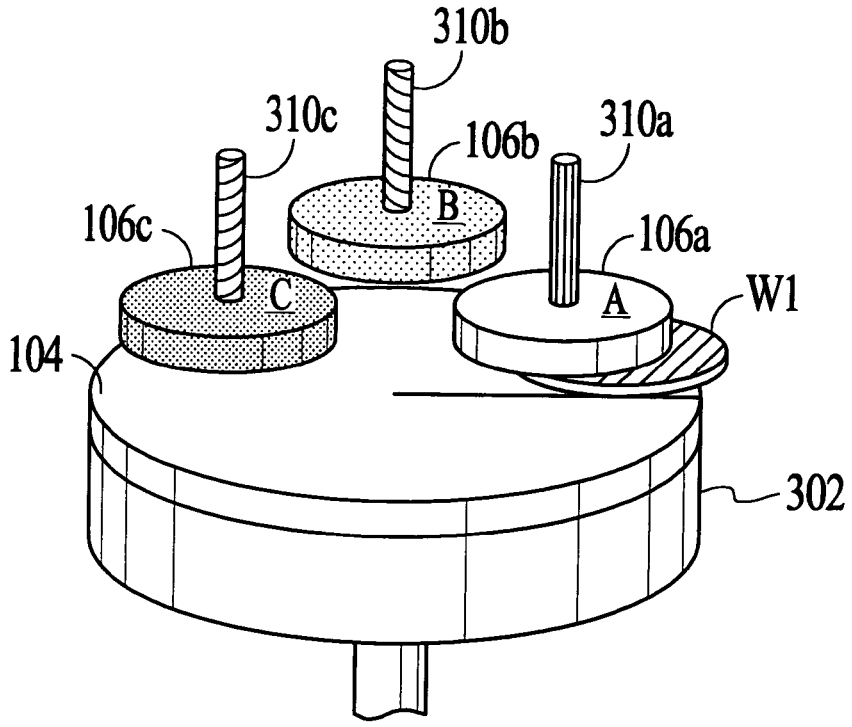
FIGS. 18–27 illustrate the operation of the CMP apparatus of FIGS. 15, 16 and 17.
Figure 19:
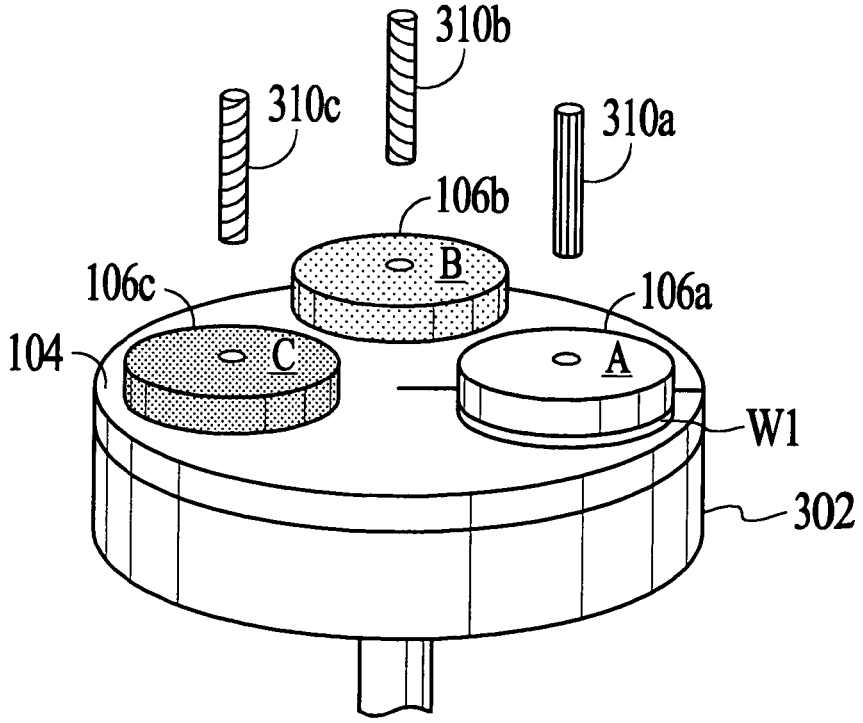
Figure 20:
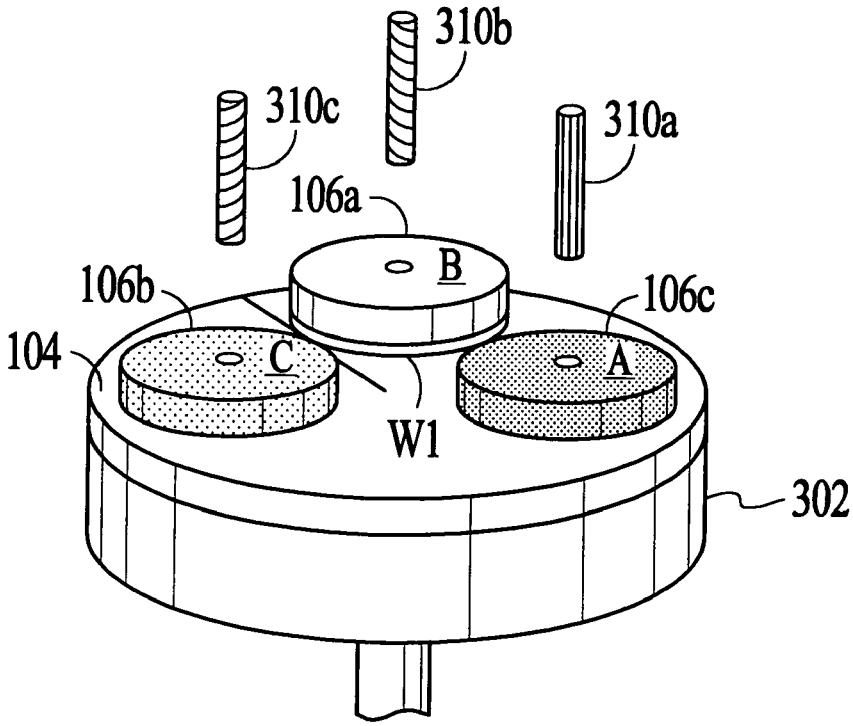

The operation of the CMP apparatus 1500 is described with reference to FIGS. 18, 19, 20, 21, 22, 23, 24, 25, 26 and 27. The rotational-and-vertical drive mechanisms 312 and the wafer transport arm 108 of the CMP apparatus 1500 are not shown in FIGS. 18–27. Initially, the wafer carriers 106 are raised above the polishing pad 104 by the carrier shafts 310, as illustrated in FIG. 18. During a first phase, a first semiconductor wafer W1 is loaded onto the wafer carrier 106*a* at the position A by the wafer transport arm, as illustrated in FIG. 18. After the semiconductor wafer W1 is loaded, the wafer carrier 106*a* is lowered so that the wafer W1 contacts the polishing pad 104. The wafer carrier 106*a* is then rotated by the carrier shaft 310*a* to polish the semiconductor wafer W1. In addition, the polishing pad is rotated at a polishing speed to polish the semiconductor wafer W1. The other wafer carriers 106*b* and 106*c* remain raised above the polishing pad. At the end of the predefined period, the rotating polishing pad is stopped and the two wafer carriers 106*b* and 106*c* are lowered to the polishing pad. All three wafer carriers are then separated from the carrier shafts, as illustrated in FIG. 19. The wafer carriers are transferred to their next positions by the rotation of the polishing pad such that the wafer carrier 106*a* is now at the position B, as illustrated in FIG. 20, which begins the next phase. The wafer carriers are aligned to their new positions by the aligners (not shown).

Figure 21:
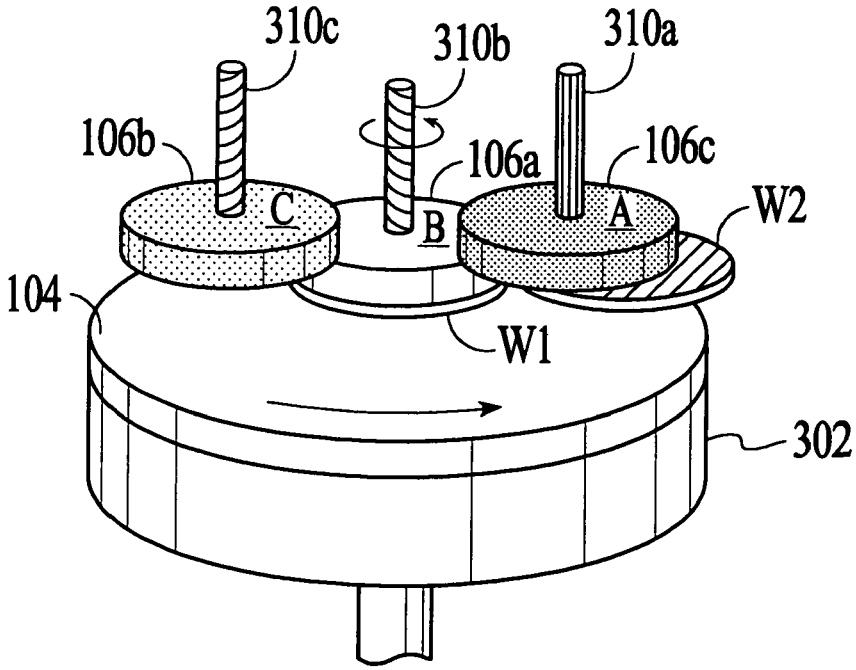
Figure 22:
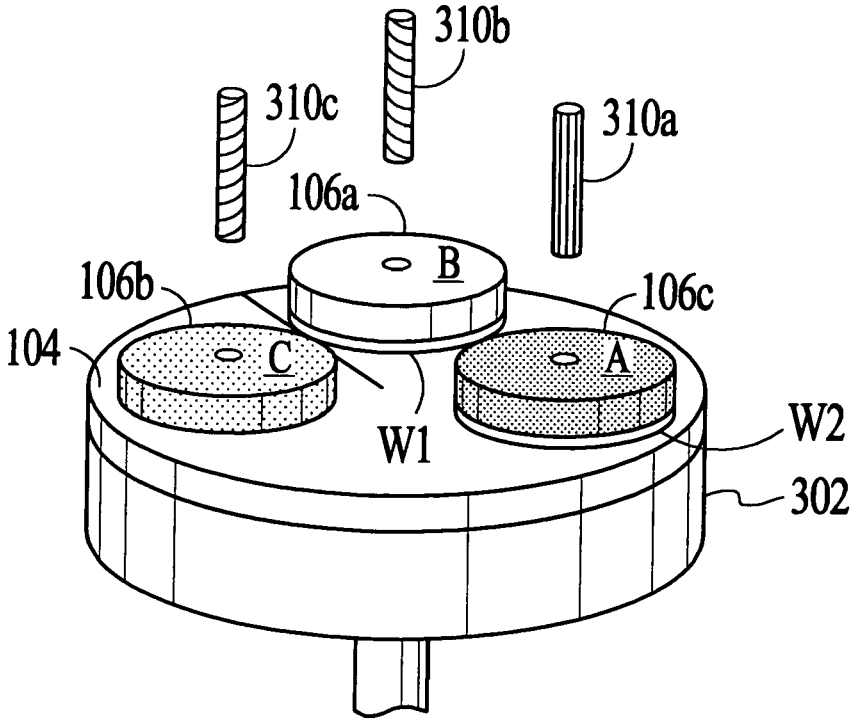
Figure 23:
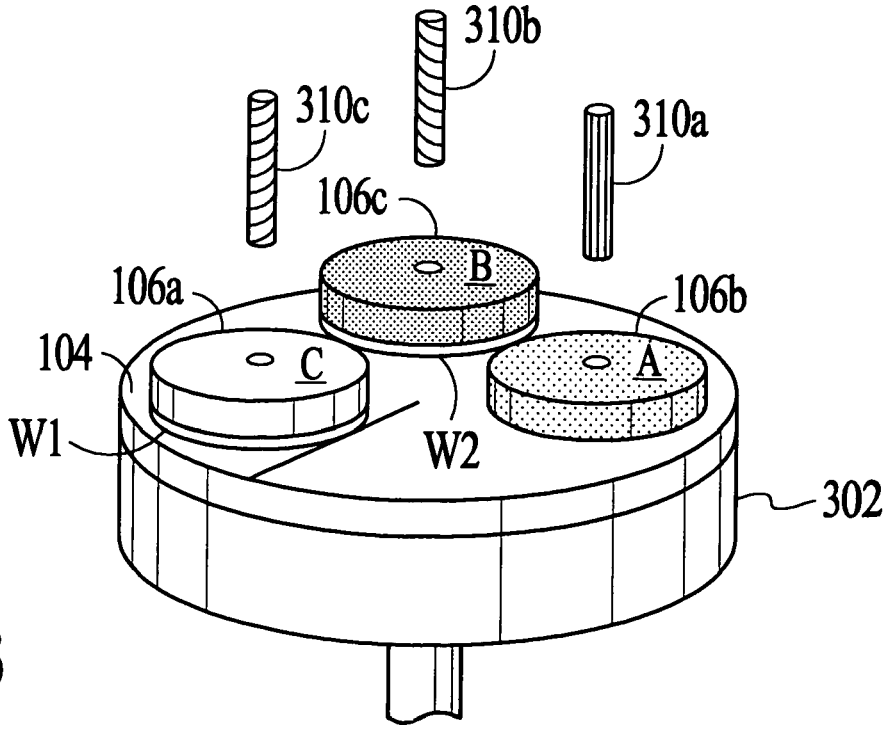

During a second phase, the wafer carriers 106*a*, 106*b* and 106*c* are connected to the carrier shafts 310*b*, 310*c* and 310*a*, respectively. The wafer carriers 106*b* and 106*c* are raised above the polishing pad 104 by the carrier shafts 310*c* and 310*a*, while the wafer carrier 106*a* with the semiconductor wafer W1 is rotated by the carrier shaft 310*b* to further polish the wafer W1, as illustrated in FIG. 21. The polishing pad is also rotated at the polishing speed to polish the semiconductor wafer W1. The wafer carrier 106*c*, now at the position A, is loaded with a second semiconductor wafer W2 by the wafer transport arm. The wafer carrier 106*c* is then lowered to begin polishing the wafer W2. After another predefined period, the rotating polishing pad is again stopped and the wafer carrier 106*b* is lowered to the polishing pad. All three wafer carriers are then separated from the carrier shafts, as illustrated in FIG. 22. The wafer carriers are transferred to their next positions by the rotation of the polishing pad such that the wafer carrier 106*a* is now at the position C, as illustrated in FIG. 23, which begins the next phase.

Figure 24:
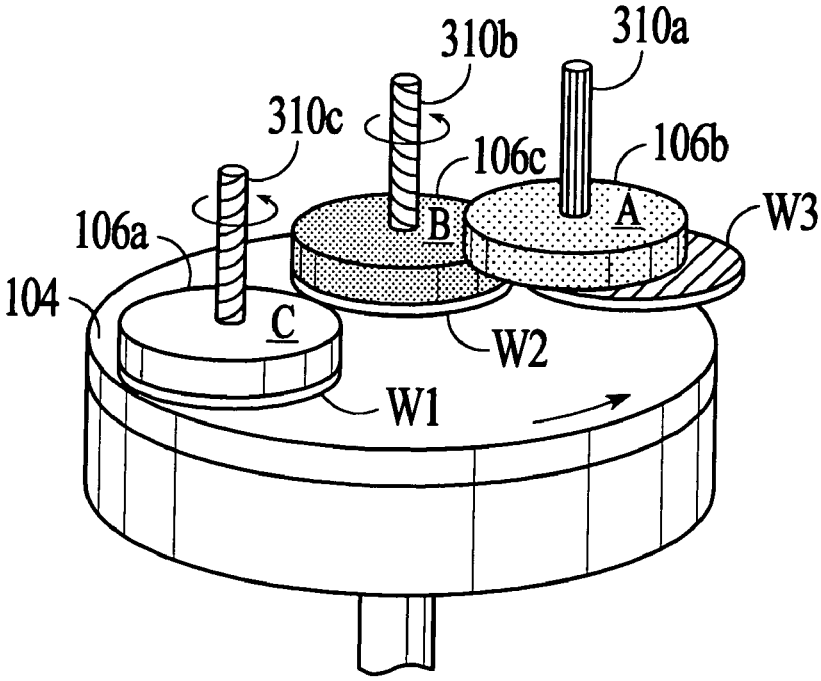
Figure 25:
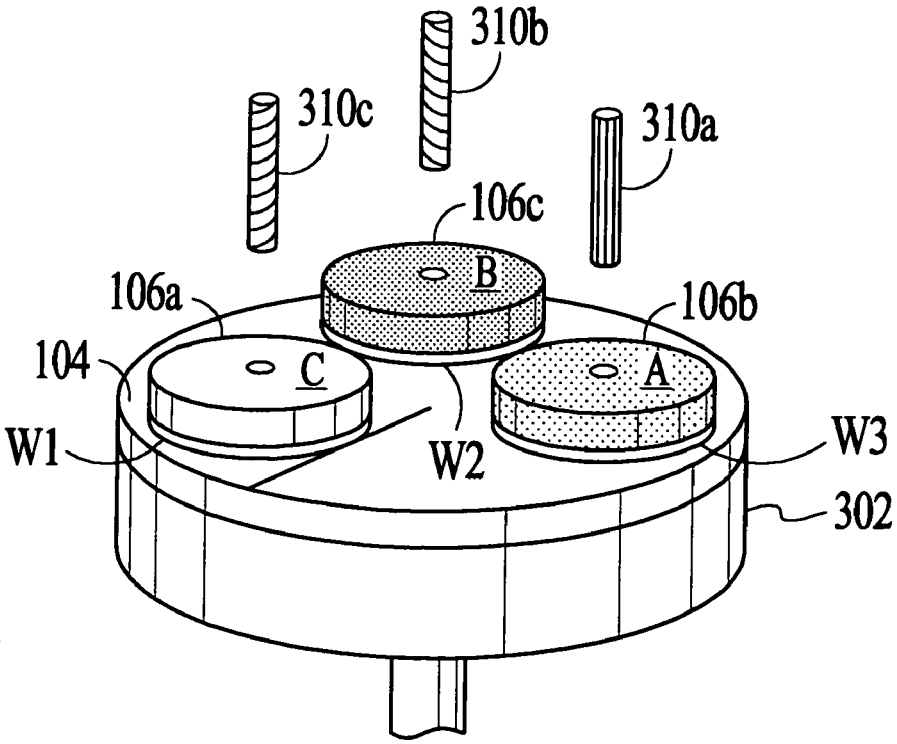
Figure 26:
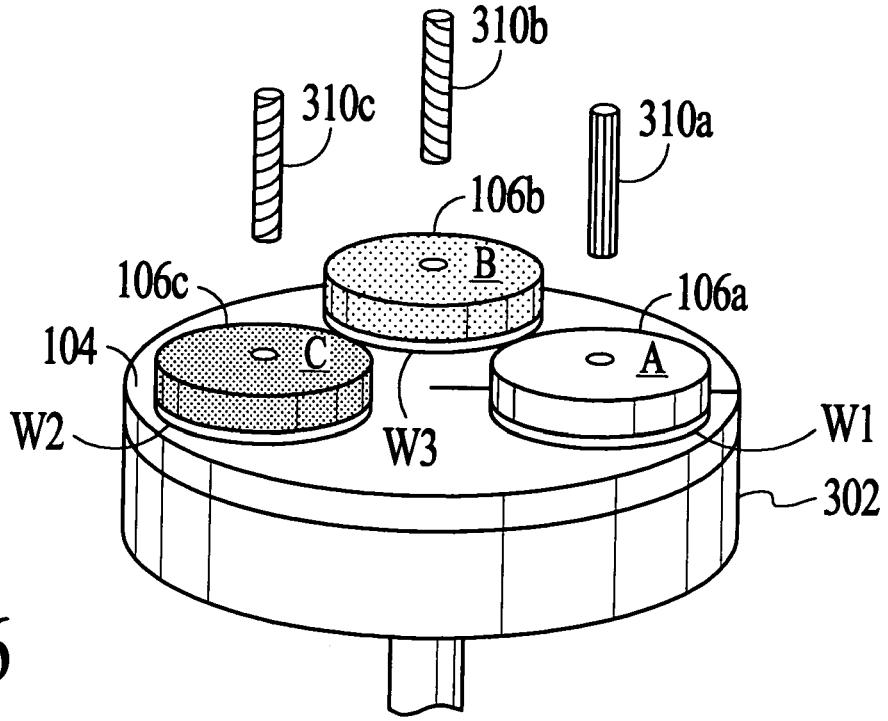

During a third phase, the wafer carriers 106*a*, 106*b* and 106*c* are connected to the carrier shafts 310*c*, 310*a* and 310*b*, respectively. The wafer carrier 106*b* is raised above the polishing pad 104 by the carrier shaft 310*a*, while the wafer carriers 106*a* and 106*b* with the semiconductor wafers W1 and W2 are rotated by the carrier shafts 310*c* and 310*b* to further polish the wafers W1 and W2, as illustrated in FIG. 24. The polishing pad 104 is again rotated to the polishing speed. The wafer carrier 106*b*, now at the position A, is loaded with a third semiconductor wafer W3 by the wafer transport arm. The wafer carrier 106*b* is then lowered to begin polishing the wafer W3. After another predefined period, the polishing pad is stopped and all three wafer carriers are then separated from the carrier shafts, as illustrated in FIG. 25. The wafer carriers are transferred to their next positions by the rotation of the polishing pad such that the wafer carrier 106*a* is now back at the position A, as illustrated in FIG. 26, which begins the next phase. Thus, the semiconductor wafer W1 has been polished at each of the positions A, B and C, which completes the polishing process for the wafer W1.

Figure 27:
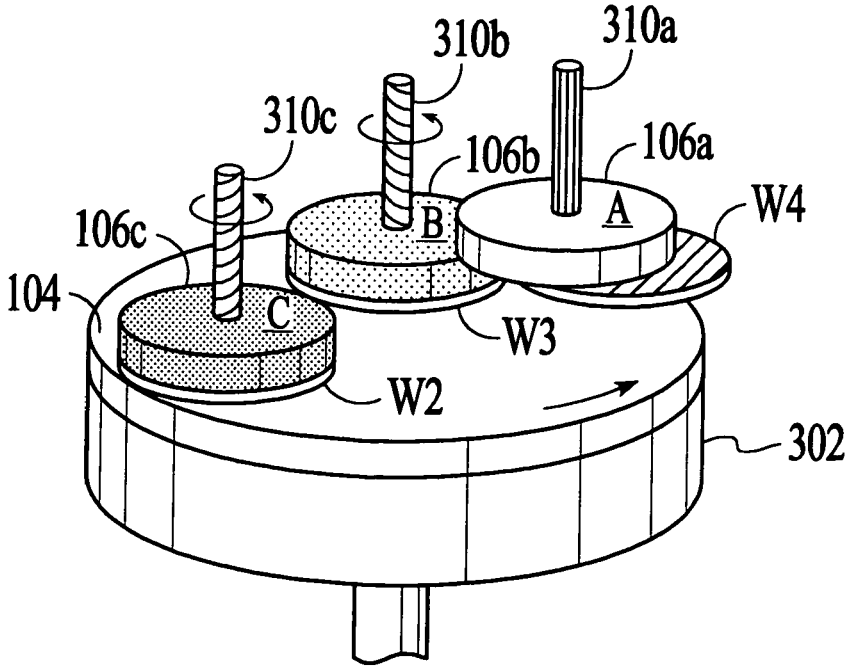

During this next phase, the semiconductor wafers W2 and W3 on the wafer carriers 106*c* and 106*b* at the positions C and B are further polished, as illustrated in FIG. 27. Concurrently, the semiconductor wafer W1 is unloaded from the wafer carrier 106*a* at the position A by the wafer transport arm. After the wafer W1 is unloaded, a fourth semiconductor wafer W4 is loaded onto the wafer carrier 106*a*, and the process is continued. In this fashion, semiconductor wafers are continuously polished at each of the positions B and C, as semiconductor wafers are loaded, unloaded and polished at the position A. Concurrent to the loading, unloading and polishing of semiconductor wafers, the polishing pad 104 is conditioned by the pad conditioning system in the same manner as described above with respect to the CMP apparatus 100.

Figure 28:
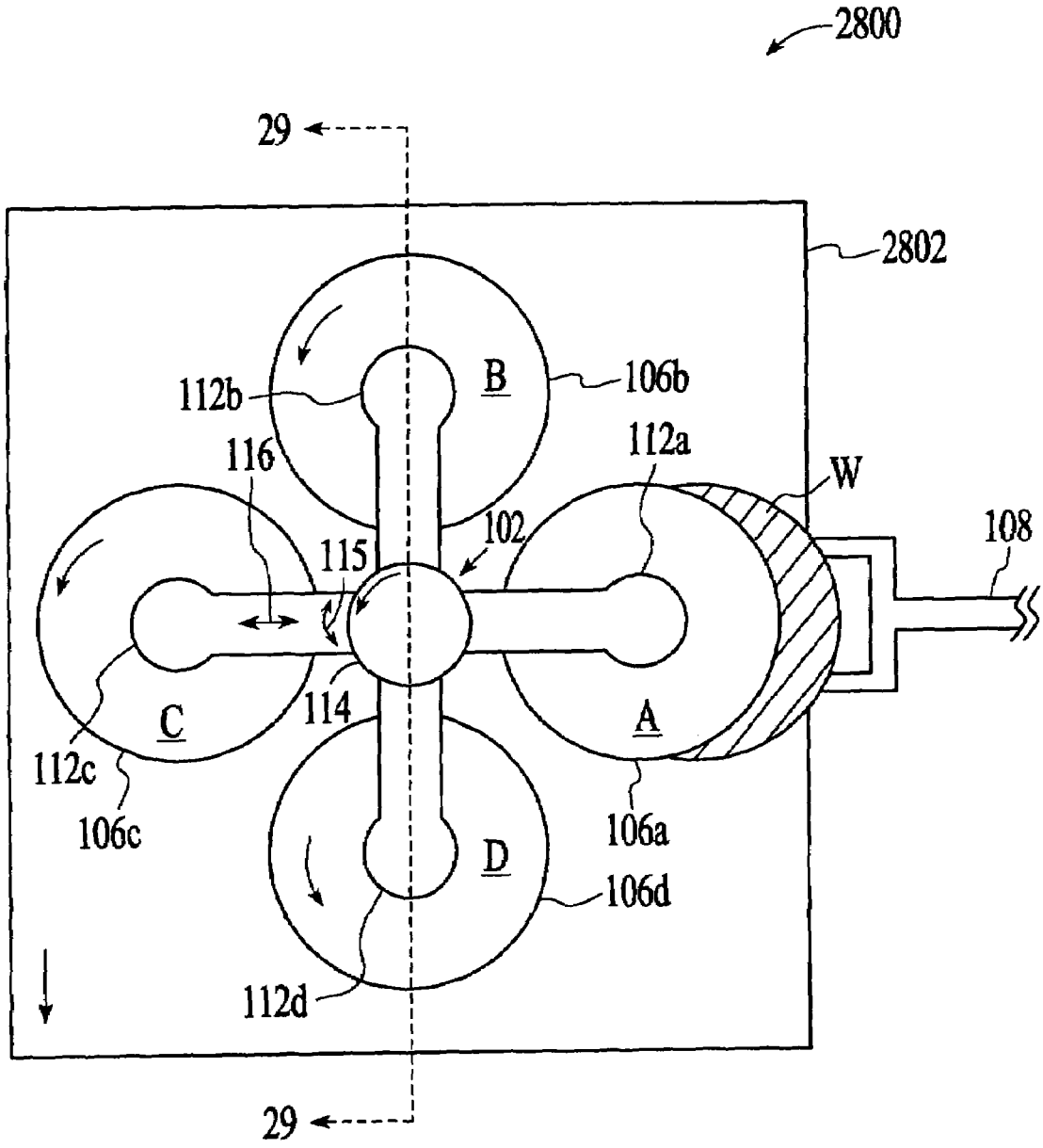
FIG. 28 is a top view of a CMP apparatus in accordance with a fourth embodiment of the present invention.
Figure 29:
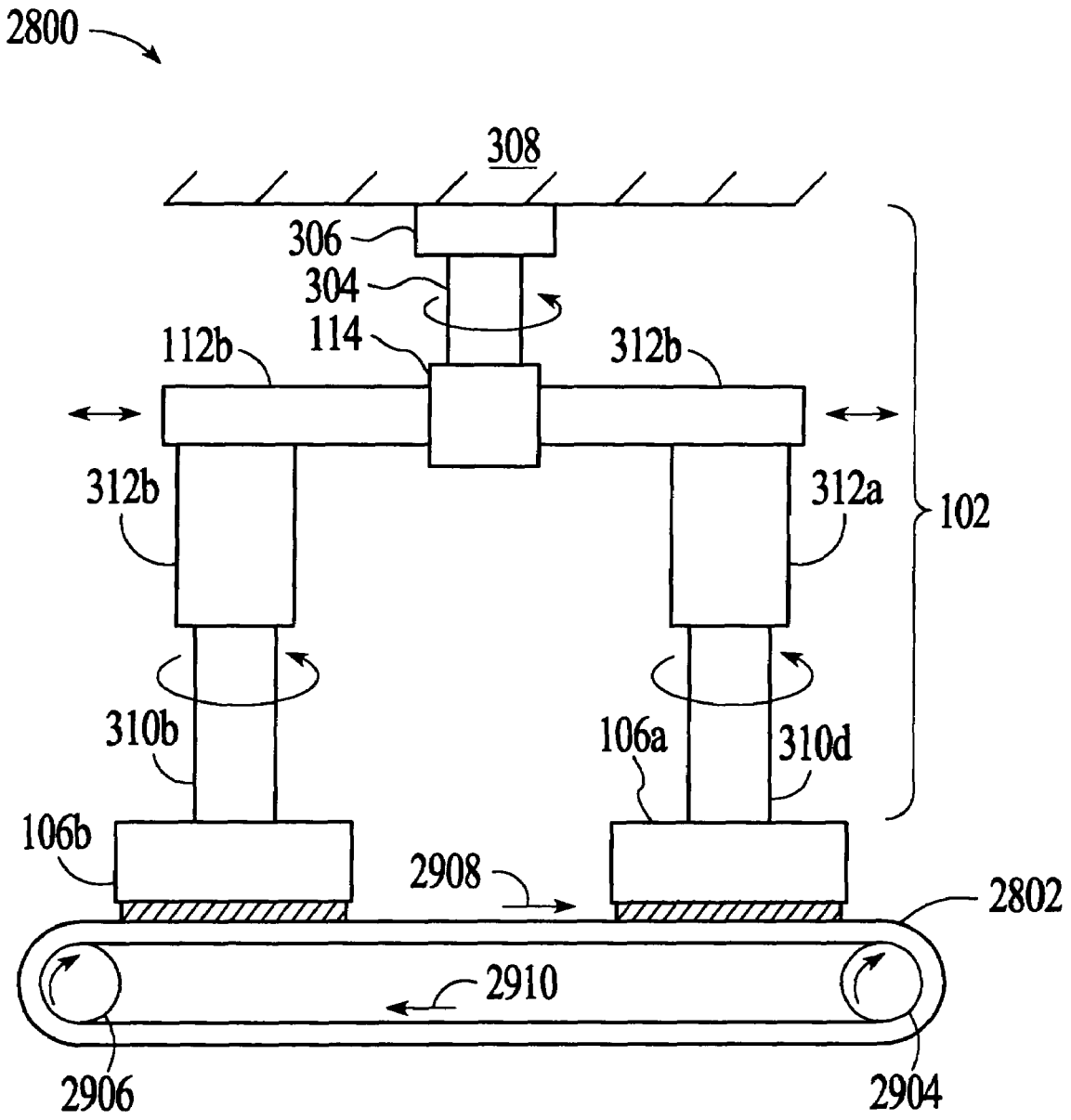
FIG. 29 is a cross-sectional view of the CMP apparatus of FIG. 28.

In FIGS. 28 and 29, a CMP apparatus 2800 in accordance with a fourth embodiment of the invention is shown. FIG. 28 is a top view of the CMP apparatus, while FIG. 29 is a cross-sectional view of the CMP apparatus along the dotted line 29—29. Similar to the CMP apparatus 100 of the first embodiment, the CMP apparatus 2800 includes the wafer transport arm 108 and the multiple wafer carriers 106 that are supported by the carrier transfer system 102. Although the CMP apparatus 2800 may be configured to include two to ten or more wafer carriers, the CMP apparatus is illustrated and described herein as including four wafer carriers. In contrast to the CMP apparatus 100 of the first embodiment, the CMP apparatus 2800 includes a linear polishing pad 2802 instead of the rotatable polishing pad 104. As illustrated in FIG. 29, the linear polishing pad is shaped as a belt that passes through pulleys 2904 and 2906. Thus, the linear polishing pad circulates in the direction indicated by the arrows 2908 and 2910.

The operation of the CMP apparatus 2800 is identical to the CMP apparatus 100 of the first embodiment, except for the movement of the linear polishing pad 2802. At the position A, a polished semiconductor wafer is unloaded from a wafer carrier and a new semiconductor wafer is loaded to that wafer carrier. The new semiconductor wafer is then polished at the position A until the end of a predefined period. Alternatively, the semiconductor wafer transferred to the position A from the position D is further polished before the unloading and loading of the wafers. At each of the positions B, C and D, a semiconductor wafer is further polished for the entire predefined period.

Similar to the CMP apparatus 100 of FIG. 10, the CMP apparatus 2800 may include two wafer transport arms (not shown), instead of the single wafer transport arm 108. In this embodiment, one of the two wafer transport arms is used exclusively to unload a polished semiconductor wafer from the wafer carrier at a predefined position, such as the position D. The other wafer transport arm is used exclusively to load a new semiconductor wafer to the wafer carrier at a different position, such as the position A. Furthermore, the positions A, B, C and D may be rearranged such that the positions A, B, C and D are situated at 45, 135, 225, 315 degrees, respectively, about the center of the wafer transfer assembly 102 in the same fashion as illustrated in FIG. 10. The rearrangement of the positions A, B, C and D would allow the two wafer transport arms to operate on the same side of the CMP apparatus 2800.

Figure 30:
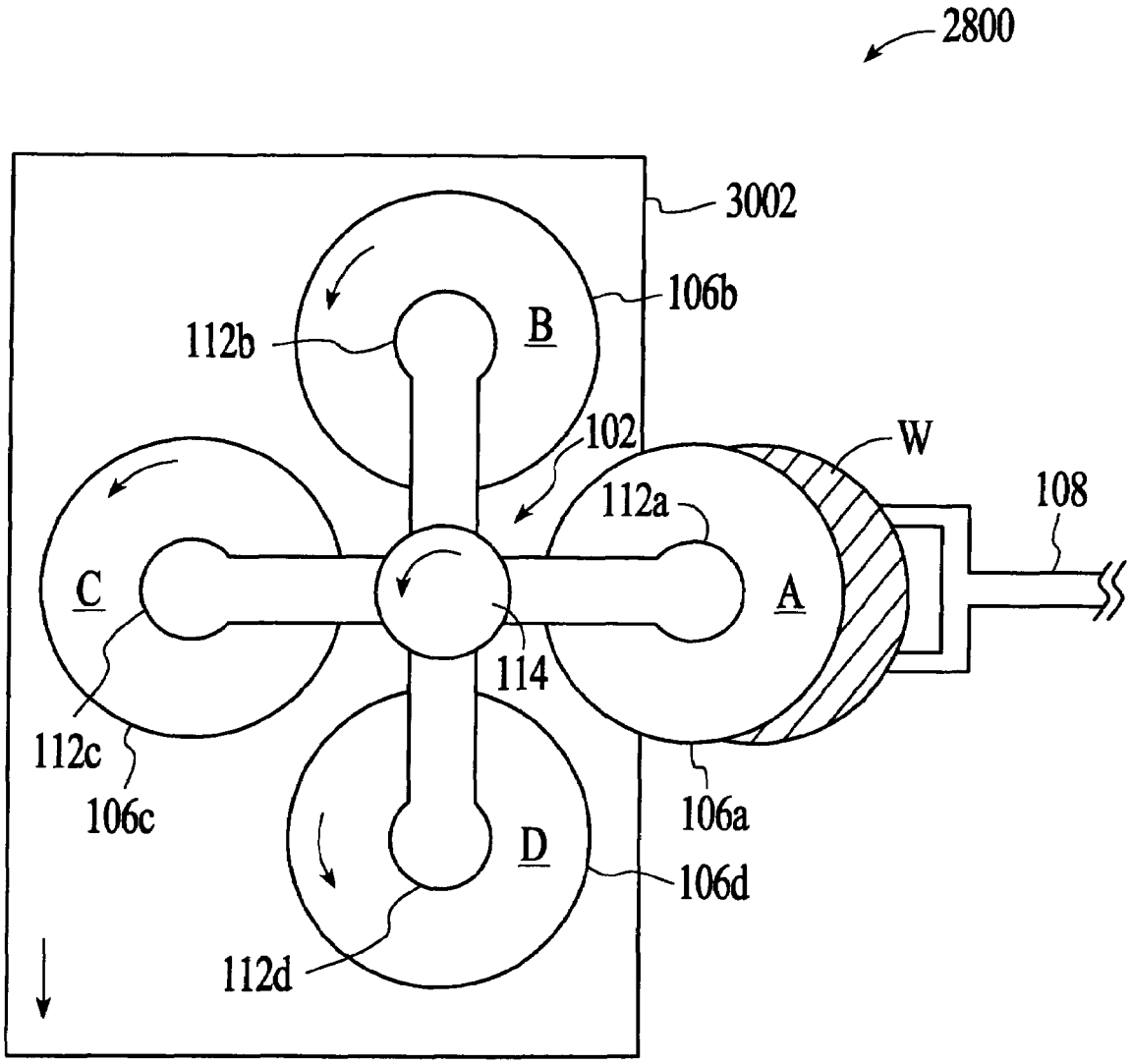
FIG. 30 is a top view of the CMP apparatus of FIGS. 28 and 29 with a narrower linear polishing pad in accordance with an alternative embodiment of the invention.
Figure 31:
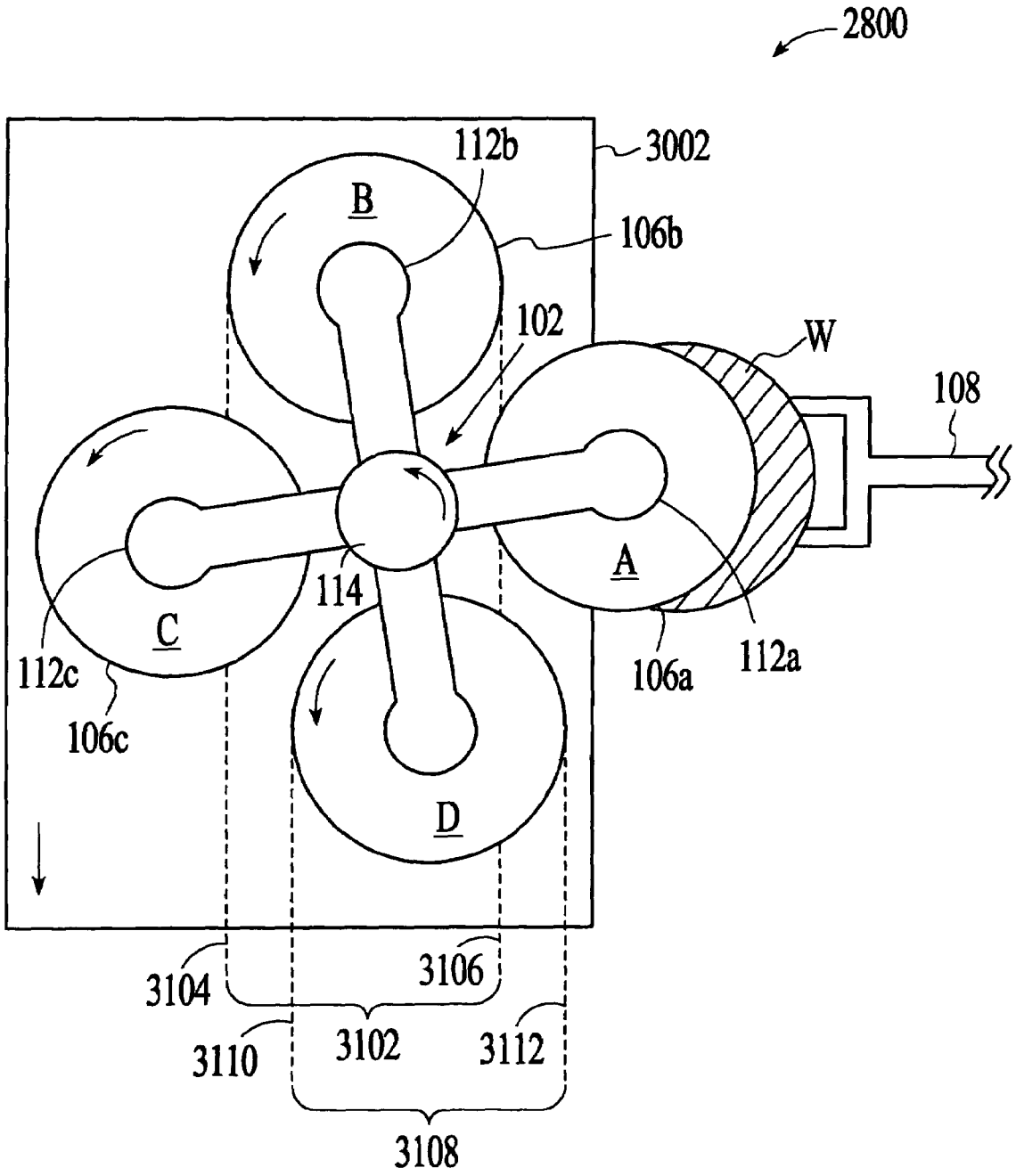
FIG. 31 is a top view of the CMP apparatus of FIGS. 28 and 29 with shifted positions for the wafer carriers in accordance with an alternative embodiment of the invention.

In an alternative embodiment, the CMP apparatus 2800 includes a linear polishing pad 3002, which has a narrower width than the linear polishing pad 2802, as shown in FIG. 30. Thus, in this embodiment, only the semiconductors wafers on the wafer carriers 106 at the positions B, C and D can be simultaneously polished on the linear polishing pad 3002. Thus, the semiconductor wafer on the wafer carrier at the position A is not polished until that wafer carrier is transferred to the position B. Furthermore, the positions A, B, C and D can be rotationally shifted such that the wafer carrier at the position B is not directly aligned with the wafer carrier at the position D along the direction of the linear polishing pad 3002, as illustrated in FIG. 31. Thus, the semiconductor wafer held by the wafer carrier at the position B contacts a portion 3102 of the linear polishing pad 3002 defined by the dotted lines 3104 and 3106. Similarly, the semiconductor wafer held by the wafer carrier at the position D contacts a portion 3108 of the linear polishing pad defined by the dotted lines 3110 and 3112. The shifted locations of the wafer carriers at the position B and D allow the semiconductor wafers being polished on these wafer carriers to contact a wider overall region of the linear polishing pad. Consequently, the linear polishing pad can be used longer than if the wafer carriers at the positions B and D contact the same portion of the linear polishing pad. The shifted configuration of the wafer carriers as shown in FIG. 31 can also be applied to the CMP apparatus of FIGS. 28 and 29.

Figure 32:
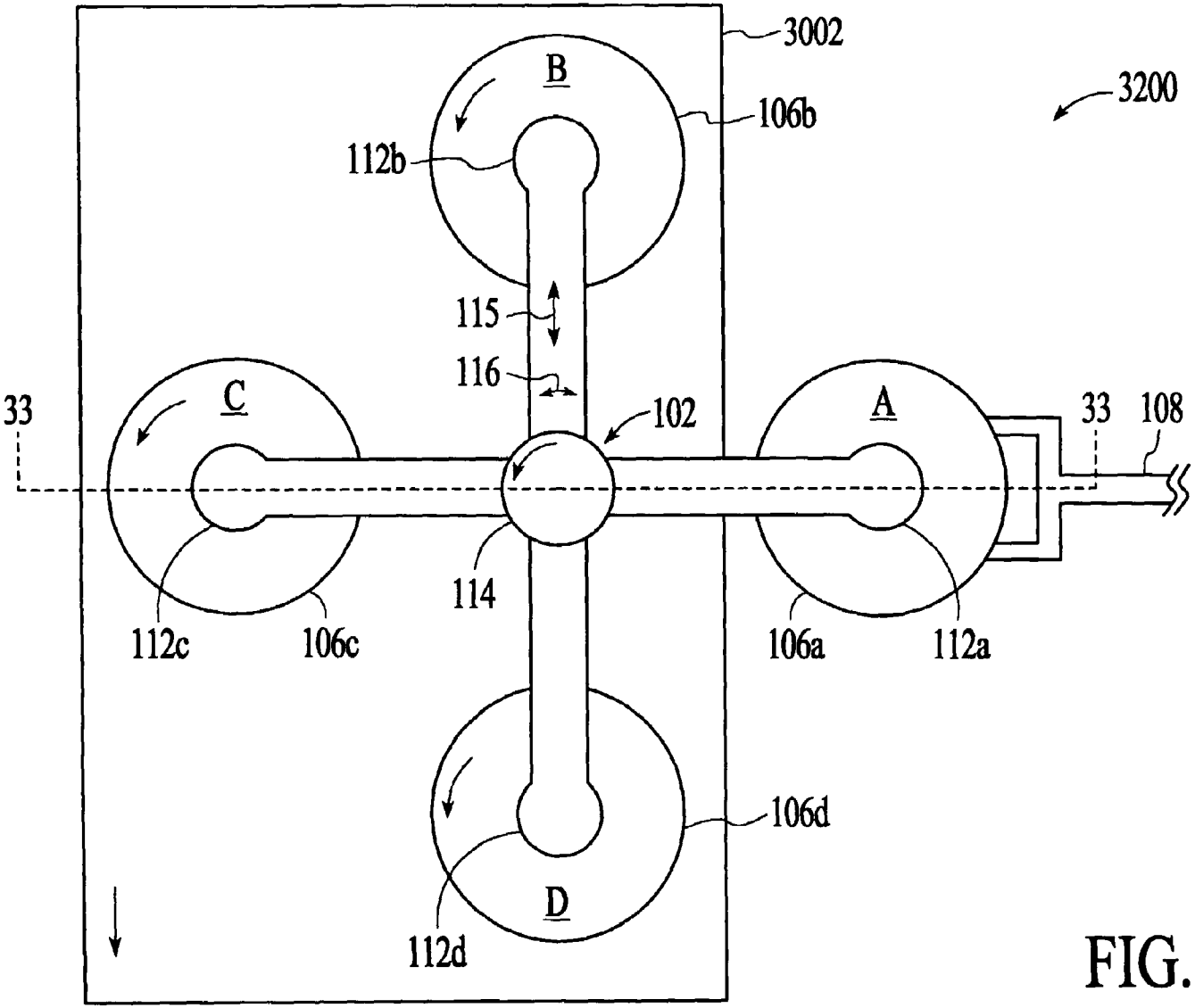
FIG. 32 is a top view of a CMP apparatus in accordance with a fifth embodiment of the present invention.
Figure 33:
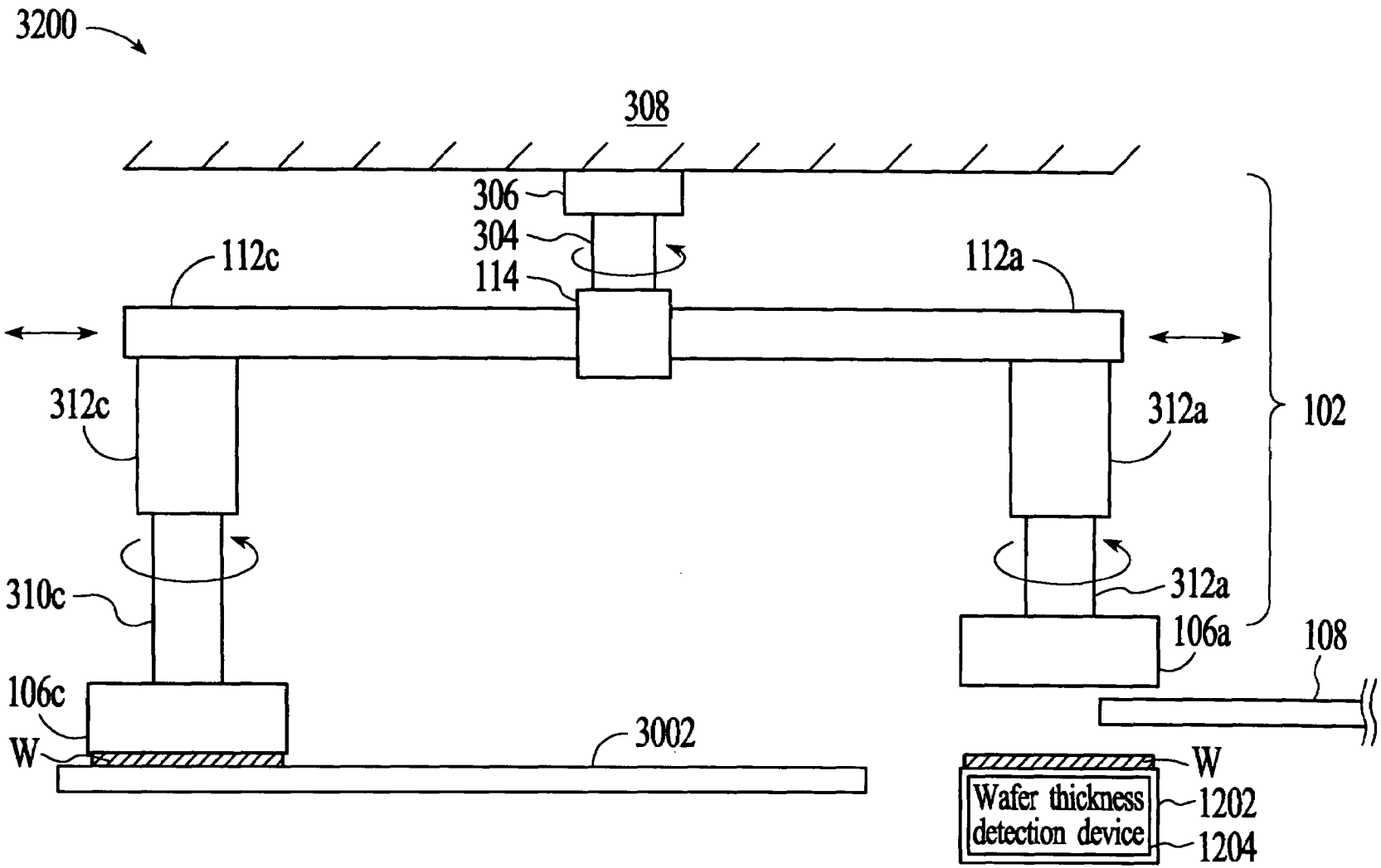
FIG. 33 is a cross-sectional view of the CMP apparatus of FIG. 32.

Turing now to FIGS. 32 and 33, a CMP apparatus 3200 in accordance with a fifth embodiment is shown. FIG. 32 is a top view of the CMP apparatus, while FIG. 33 is a cross-sectional view of the CMP apparatus along the dotted line 33—33. The CMP apparatus 3200 is similar to the CMP apparatus 2800 of FIG. 30. However, in this embodiment, the CMP apparatus 3200 further includes the wafer unload/load cup unit 1202, which is situated adjacent to the linear polishing pad 3002, as shown in FIG. 33. The wafer unload/load cup unit operates as a transfer station for the wafer carriers 106 to load and unload semiconductor wafers. In one embodiment, the wafer transport arm 108 is used exclusively to transport semiconductor wafers to and from the wafer unload/load cup unit. In another embodiment, the wafer transport arm is further used to transport semiconductor wafers between the wafer unload/load cup unit and the wafer carrier at the position A. The wafer unload/load cup unit may include the optional wafer thickness detection device 1204 to measure the thickness of semiconductor wafers as the wafers are being transferred between the wafer transport arm and the wafer carriers.

The CMP apparatus 3200 includes the wafer transfer system 102, which is the same wafer transfer system included in the CMP apparatus 2800 of FIG. 30. However, in this embodiment, the carrier positioning arms 112 are extended such that the wafer carriers 106 are situated over the wafer unload/load cup unit 1202 when transferred to the position A.

Figure 34:
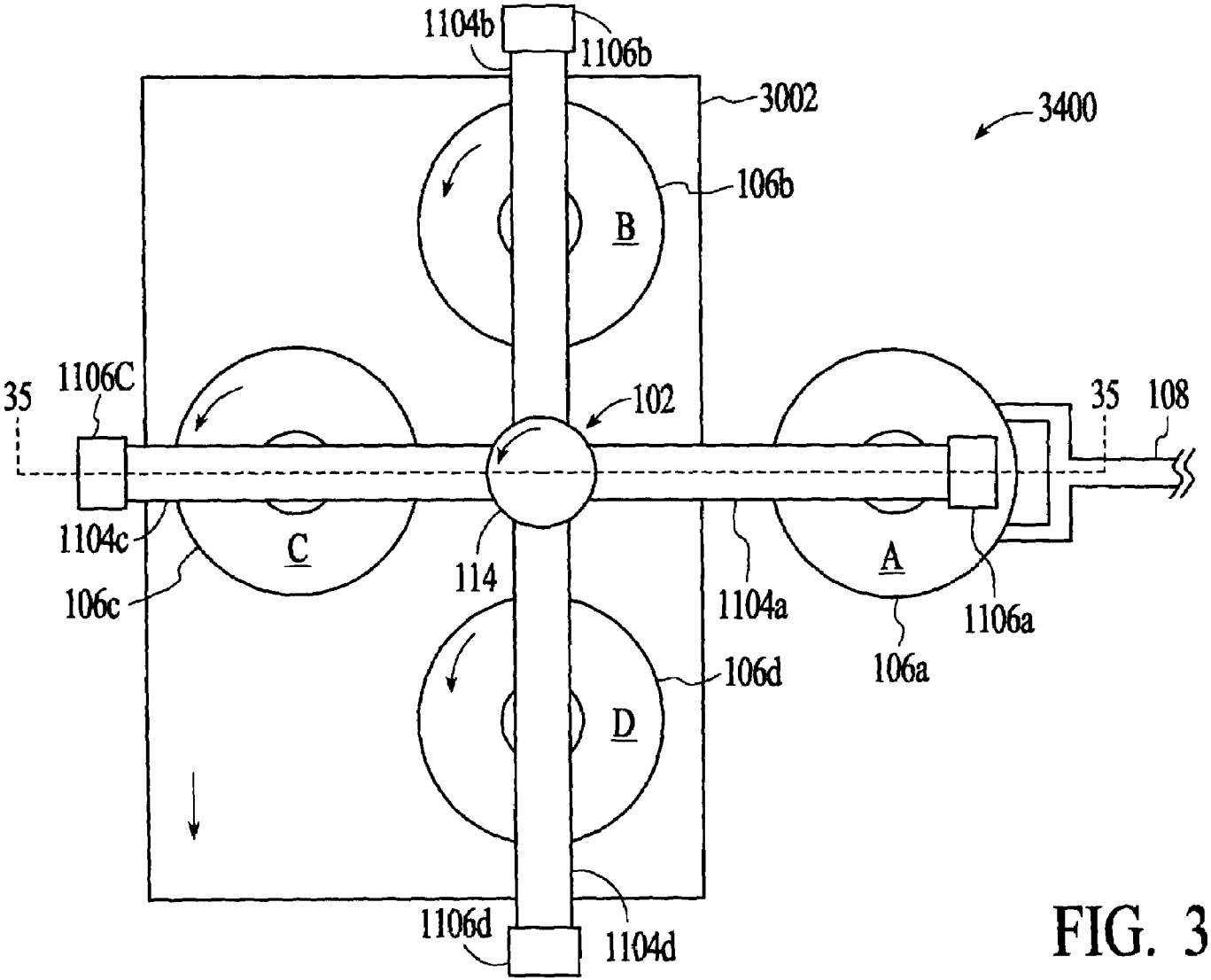
FIG. 34 is a top view of a CMP apparatus in accordance with a sixth embodiment of the present invention.
Figure 35:
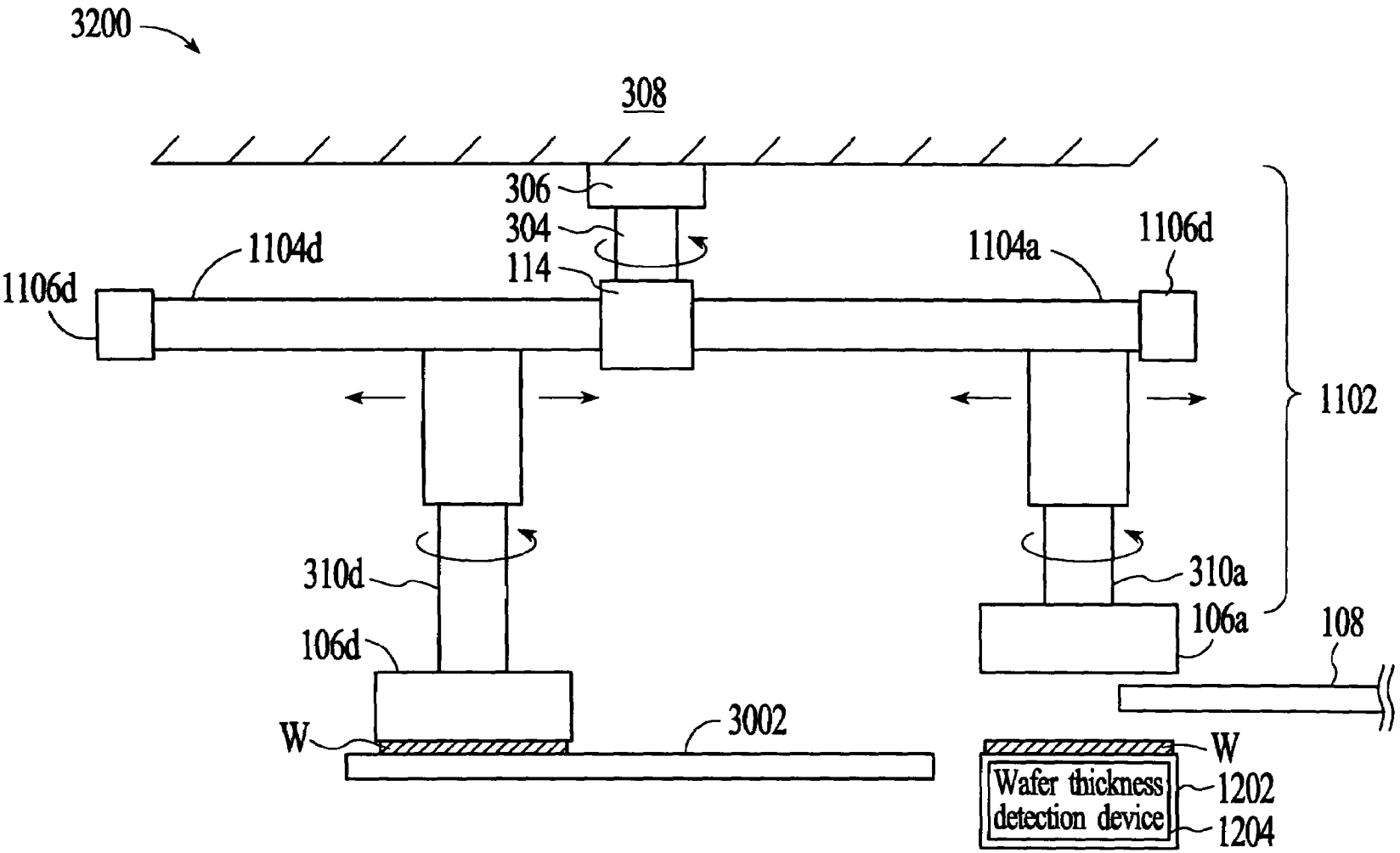
FIG. 35 is a cross-sectional view of the CMP apparatus of FIG. 34.

In FIGS. 34 and 35, a CMP apparatus 3400 in accordance with a sixth embodiment is shown. FIG. 34 is a top view of the CMP apparatus, while FIG. 35 is a cross-sectional view of the CMP apparatus along the dotted line 35—35. The CMP apparatus 3400 is similar to the CMP apparatus 3200 of FIGS. 32 and 33. However, in this embodiment, the CMP apparatus 3200 further includes the wafer transfer system 1102, which is the same wafer transfer system included in the CMP apparatus 1100 of FIGS. 11 and 12. The wafer transfer system 1102 allows the wafer carriers 106 to be displaced along the carrier positioning arms 1104 such that the wafer carriers 106 are situated closer together when the wafer carriers are transferred over the linear polishing pad 3002 for wafer polishing. Consequently, the linear polishing pad may be smaller with respect to the polishing surface area than the linear polishing pad of the CMP apparatus 3200 of FIGS. 32 and 33.

Figure 36:
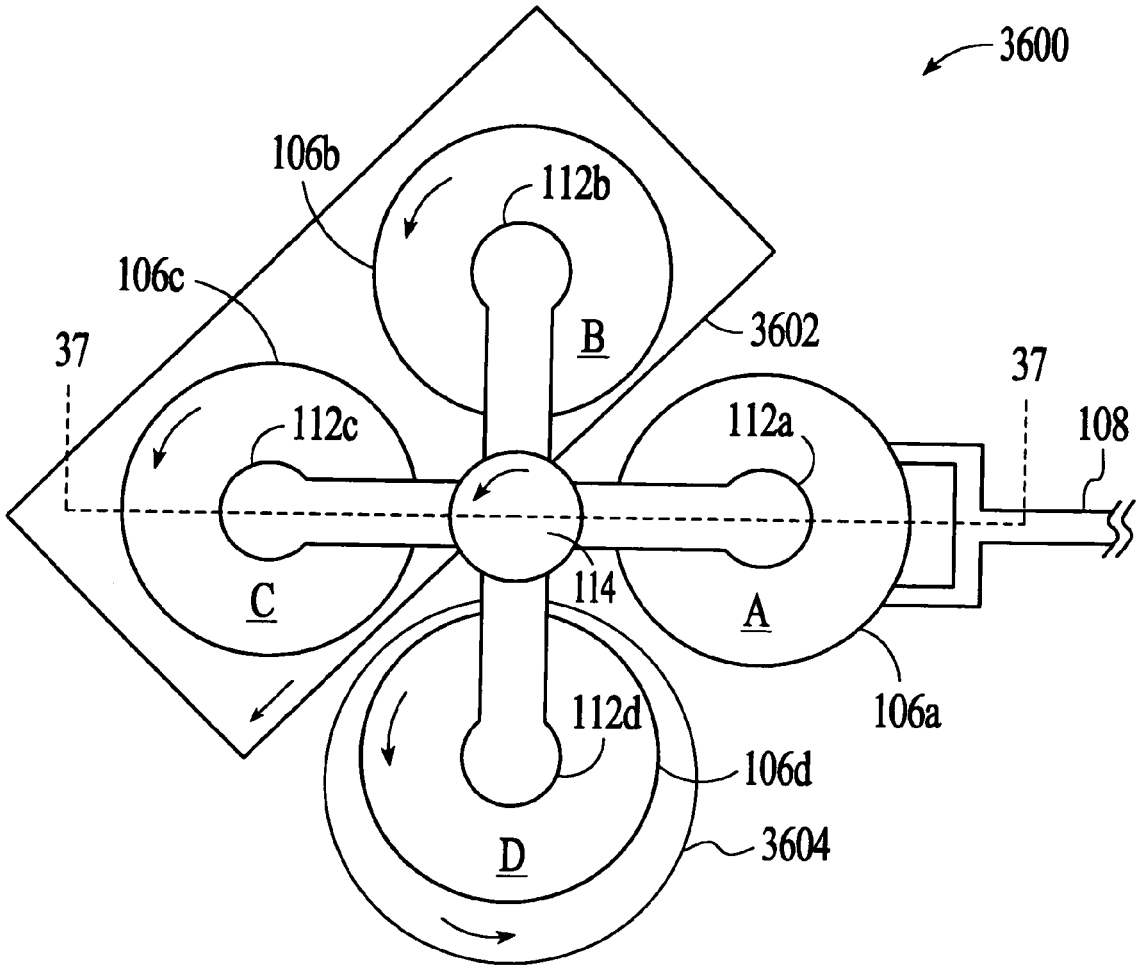
FIG. 36 is a top view of a CMP apparatus in accordance with a seventh embodiment of the present invention.
Figure 37:
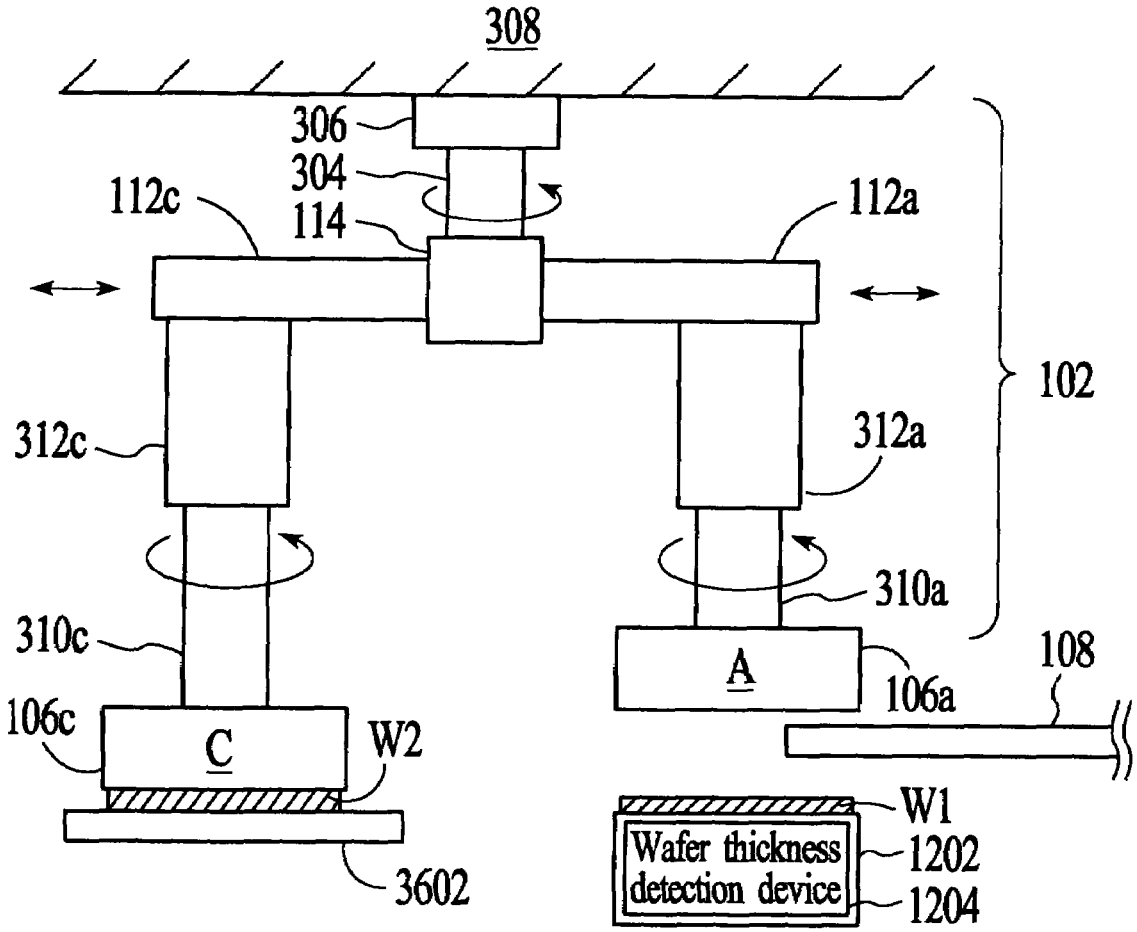
FIG. 37 is a cross-sectional view of the CMP apparatus of FIG. 36.

Turning now to FIGS. 36 and 37, a CMP apparatus 3600 in accordance with a seventh embodiment is shown. FIG. 36 is a top view of the CMP apparatus, while FIG. 37 is a cross-sectional view of the CMP apparatus along the dotted line 37—37. In this embodiment, the CMP apparatus includes a linear polishing pad 3602, a rotatable polishing pad 3604 and the wafer unload/load cup unit 1202. As shown in FIG. 36, the positions B and C are situated over the linear polishing pad 3602, while the position D is situated over the rotatable polishing pad 3604. Thus, semiconductor wafers are polished by the linear pad at the positions B and C, and then further polished by the rotatable polishing pad at the position D. Alternatively, the semiconductor wafers may be polished by the linear pad at the positions B and C, and then buffed by the rotatable polishing pad at the position D. In an alternative embodiment, the polishing pad 3604 may also be a linear polishing pad.

The CMP apparatus 3600 is shown in FIGS. 36 and 37 to include the wafer transfer system 102, which is the same wafer transfer system included in the CMP apparatus 100 of FIGS. 1, 2 and 3. However, the CMP apparatus 3600 may instead include the wafer transfer system 1102 of the CMP apparatus of FIGS. 11 and 12. The type of wafer transfer system included in the CMP apparatus 3600 depends on the arrangement of the wafer unload/load cup unit 1202 and the polishing pads 3602 and 3604.

Similar to the other embodiments, the CMP apparatus 3600 may be configured to include two to ten or more wafer carriers 106. In the case where the CMP apparatus includes more than four wafer carriers, the polishing pads 3602 and 3604 may be configured to accommodate more wafer carriers than shown in FIG. 36. As an example, if the CMP apparatus includes six wafer carriers, the linear polishing pad may accommodate three wafer carriers, while the rotatable polishing pad may accommodate two wafer carriers.

In operation, a given semiconductor wafer, e.g., the semiconductor wafer W1, is transported to the wafer unload/load cup unit 1202 by the transport arm 108. The thickness of the semiconductor wafer W1 may be measured by the optional wafer thickness detection device 1204 included in the wafer unload/load cup unit. The wafer carrier 106 at the position A, e.g., the wafer carrier 106*a*, then secures the semiconductor wafer W1 to the lower surface of the wafer carrier 106*a*. Alternatively, the wafer transport arm transports the semiconductor wafer W1 from the wafer unload/load cup unit to the wafer carrier 106*a*. The wafer carrier 106*a* is then transferred to the position B by the carrier transfer system 102. At the position B, the semiconductor wafer W1 is polished by the linear polishing pad 3602 for a predefined period. At the end of the predefined period, the wafer carrier 106*a* is transferred to the position C by the carrier transfer system 102, where the semiconductor wafer W1 is further polished by the linear polishing pad for the predefined period. Since the semiconductor wafer W1 remains on the linear polishing pad as the wafer carrier 106*a* is transferred from the position B to the position C, the wafer may continuously be polished during this transfer.

Next, the wafer carrier 106*a* is transferred to the position D, where the semiconductor wafer W1 is further polished or buffed by the rotatable polishing pad 3604 for the predefined period. At the end of the predefined period, the wafer carrier 106*a* is transferred back to the position A, where the semiconductor wafer W1 is unloaded onto the wafer unload/load cup unit 1202. The thickness of the polished semiconductor wafer W1 may again be measured by the optional wafer thickness detection device. The difference in the measured thickness of the semiconductor wafer W1 before and after the polishing can be used to adjust the polishing parameters of the CMP apparatus 3600. The semiconductor wafer W1 is then removed from the wafer unload/load cup unit by the wafer transport arm 108, and a new semiconductor wafer is placed on the wafer unload/load cup unit by the wafer transport arm. The process is repeated for the new semiconductor wafer to be polished.

Although the CMP apparatuses 100, 1100, 1500, 2800, 3200, 3400 and 3600 have been described herein as being orientated such that the polishing surface of the polishing pads 104 and 2802, 3002, 3602 and 3604 are facing upward, the CMP apparatuses may be orientated such that the polishing surfaces of the polishing pads are facing downward. Alternatively, the CMP apparatuses may be orientated such that the polishing surfaces of the polishing pad are vertical to the ground.

Figure 38:
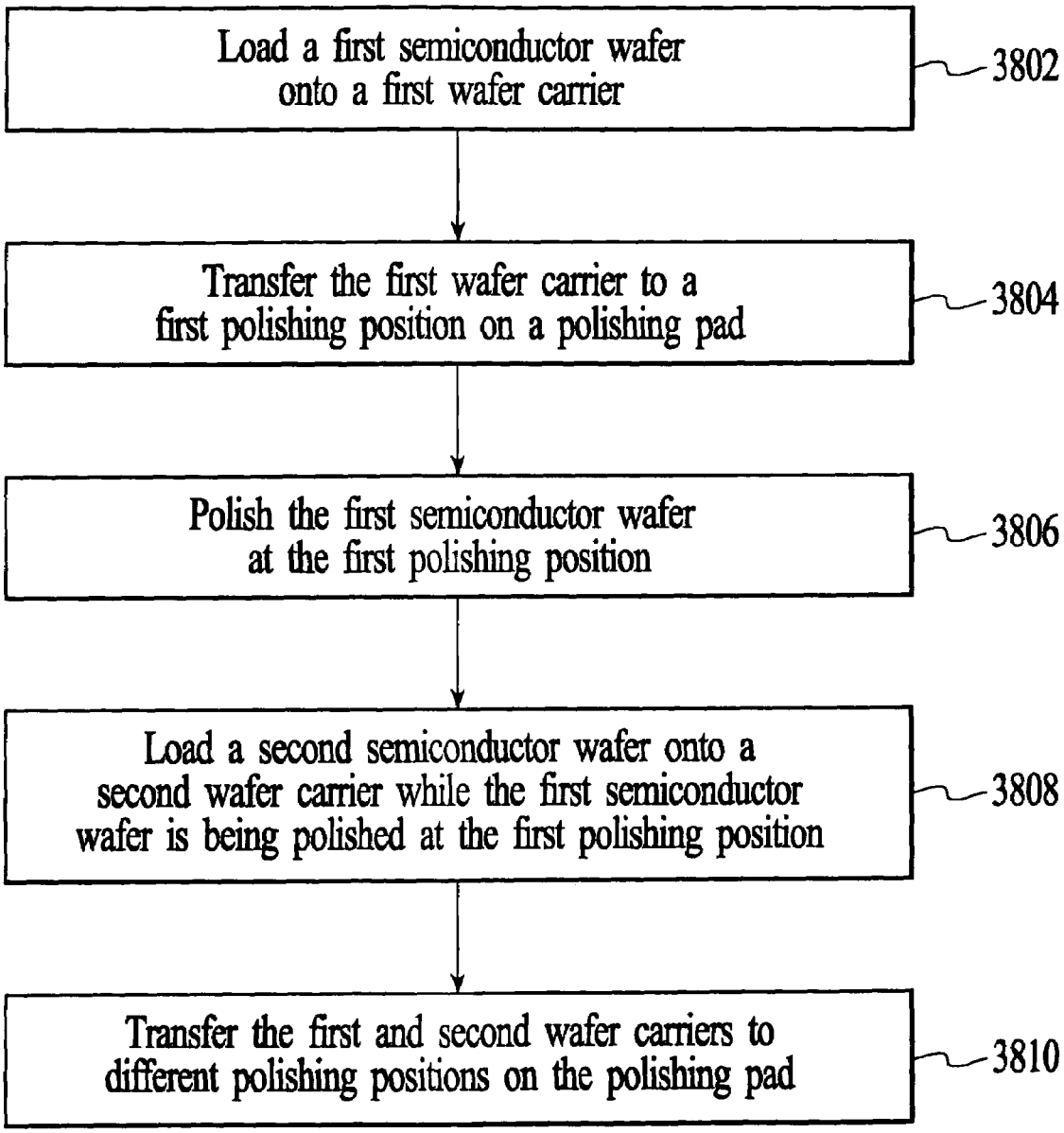
FIG. 38 is a process flow diagram of a method of polishing surfaces of semiconductor wafers in accordance with the present invention.

A method of polishing surfaces of semiconductor wafers in accordance with the present invention is described with reference to FIG. 38. At step 3802, a first semiconductor wafer is loaded onto a first object carrier. Next, at step 3804, the first semiconductor wafer is transferred to a first polishing position on a polishing pad. The polishing pad may be a rotatable polishing pad or a linear polishing pad. The first semiconductor wafer is then polished at the first polishing position on the polishing pad, at step 3806. At step 3808, a second semiconductor wafer is loaded onto a second wafer carrier while the first semiconductor wafer is being polished at the first polishing position. Next, at step 3810, the first and second wafer carriers are transferred to different polishing positions on the polishing pad to exclusively polish the first and second semiconductor wafers on the polishing pad. In this fashion, semiconductor wafers can be sequentially polished in an efficient manner.

The invention claimed is:

1. An apparatus for polishing surfaces of objects comprising:

a polishing belt of a predefined width having a polishing surface;

a plurality of object carriers, said object carriers being configured to secure said objects to be polished; and a carrier transfer assembly that is configured to sequentially transfer each of said object carriers to different positions on said polishing belt to polish said objects on said polishing surface of said polishing belt.

2. The apparatus of claim 1 further comprising a first object transport device that sequentially transports said objects to said object carriers when said object carriers are transferred to a first location that is associated with a first position of said different positions.

3. The apparatus of claim 2 wherein said first object transport device is configured to sequentially transport said objects from said object carriers when said object carriers are situated at said first location.

4. The apparatus of claim 2 wherein said first location laterally coincides with said first position of said different positions on said polishing belt.

5. The apparatus of claim 2 further comprising a second object transport device that sequentially transports said objects from said object carriers when said object carriers are transferred to a second location that is associated with a second position of said different positions.

6. The apparatus of claim 5 wherein said second location laterally coincides with said second position of said different positions on said polishing belt.

7. The apparatus of claim 1 further comprising a first object transfer station that is situated adjacent to said polishing belt to transfer said objects to said object carriers for polishing.

8. The apparatus of claim 7 wherein said object transfer station includes a thickness detection device to measure the thickness of said objects.

9. The apparatus of claim 7 further comprising a second object transfer station that is situated adjacent to said polishing belt, said second object transfer station providing a place to transfer said objects from said object carriers after said objects have been polished.

10. The apparatus of claim 9 wherein said object transfer station includes a thickness detection device to measure the thickness of said objects after said objects have been polished.

11. The apparatus of claim 1 wherein said predefined width of said polishing belt is sufficiently wide to accommodate said object carriers such that all of said object carriers can be placed on said polishing surface of said polishing belt.

12. The apparatus of claim 1 further comprising a rotatable polishing pad that is situated adjacent to said polishing belt, and wherein said carrier transfer assembly is further configured to sequentially transfer said object carriers to said rotatable polishing pad.

13. The apparatus of claim 1 wherein said different positions are misaligned with respect to said direction of said polishing pad.

14. The apparatus of claim 1 wherein said carrier transfer assembly is configured to radially move each of said object carriers independently.

15. The apparatus of claim 1 wherein said carrier transfer assembly is configured to move each of said object carriers independently in a lateral direction, said lateral direction being substantially perpendicular to a radial direction of said polishing pad.

* * * * *